US010634142B2

(12) United States Patent
Doepker et al.

(10) Patent No.: US 10,634,142 B2
(45) Date of Patent: Apr. 28, 2020

(54) COMPRESSOR OIL SEPARATION AND ASSEMBLY METHOD

(71) Applicant: Emerson Climate Technologies, Inc., Sidney, OH (US)

(72) Inventors: Roy J. Doepker, Lima, OH (US); Robert J. Comparin, Camden, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 417 days.

(21) Appl. No.: 15/453,469

(22) Filed: Mar. 8, 2017

(65) Prior Publication Data

US 2017/0268515 A1 Sep. 21, 2017

Related U.S. Application Data

(60) Provisional application No. 62/310,953, filed on Mar. 21, 2016.

(51) Int. Cl.
*F04C 29/04* (2006.01)
*F04C 23/02* (2006.01)
(Continued)

(52) U.S. Cl.
CPC ..... *F04C 29/045* (2013.01); *F04C 18/0215* (2013.01); *F04C 23/008* (2013.01);
(Continued)

(58) Field of Classification Search
CPC .. F04C 18/0215; F04C 23/008; F04C 29/023; F04C 29/026; F04C 29/028;
(Continued)

(56) References Cited

U.S. PATENT DOCUMENTS 2,753,473 A * 7/1956 Hamm ..... H02K 9/06 310/60 R
4,545,742 A * 10/1985 Schaefer ..... F04C 29/042 417/366
(Continued)

FOREIGN PATENT DOCUMENTS

CN 1482365 A 3/2004
CN 101583777 A 11/2009
(Continued)

OTHER PUBLICATIONS

International Preliminary Report on Patentability regarding International Application No. PCT/US2017/023204 dated Sep. 25, 2018.
(Continued)

*Primary Examiner* — Peter J Bertheaud
(74) *Attorney, Agent, or Firm* — Harness, Dickey & Pierce, P.L.C.

(57) ABSTRACT

A compressor may include a shell, a compression mechanism, a bearing housing, a shroud, a stator, and a rotor. The compression mechanism includes a scroll member that is attached to the shell. The shroud is rotatably fixed relative to the shell and attached to the bearing housing. The stator is fixed relative to the shell. The shroud may have an annular body including an inner surface defining a center shroud passage. The stator may have an outer surface defining a stator passage. An outer surface of the rotor and an inner surface of the stator may be spaced apart and define a discharge gap in fluid communication with the center shroud passage and the stator passage. A continuous passage may extend between a top surface of the scroll member and a bottom surface of the shroud and may be in fluid communication with the shroud passage.

21 Claims, 25 Drawing Sheets

(51) Int. Cl.
*F04C 23/00* (2006.01)
*F04C 18/02* (2006.01)
*F04C 29/02* (2006.01)

(52) U.S. Cl.
CPC ..... *F04C 23/02* (2013.01); *F04C 29/026* (2013.01); *F04C 2240/40* (2013.01); *F04C 2240/50* (2013.01); *F04C 2240/807* (2013.01)

(58) Field of Classification Search
CPC .... F04C 29/045; F04C 29/12; F04C 2240/30; F04C 2240/603; H02K 1/32; F04B 39/06; Y10S 417/902
See application file for complete search history.

(56) References Cited

U.S. PATENT DOCUMENTS 4,545,747 A * 10/1985 Tamura ..... F04C 18/0215 418/55.1
4,696,629 A * 9/1987 Shiibayashi ..... F04C 23/008 29/888.022
4,755,114 A * 7/1988 Shibayashi ..... B01D 46/0031 418/55.6
5,015,159 A * 5/1991 Mine ..... F02M 37/08 123/41.31
5,263,822 A * 11/1993 Fujio ..... F04C 18/0215 418/55.4
6,387,142 B1 5/2002 Pieciak et al.
7,708,532 B2 5/2010 Ogawa et al.
8,043,079 B2 10/2011 Yoo et al.
8,074,471 B2 12/2011 Hasegawa et al.
8,366,425 B2 2/2013 Arai et al.
2004/0057837 A1 3/2004 Skinner
2004/0057848 A1 3/2004 Haller et al.
2010/0003147 A1 1/2010 Takahashi et al.
2011/0033324 A1 2/2011 Schaefer et al.
2014/0333163 A1* 11/2014 Horii ..... H02K 1/20 310/59

FOREIGN PATENT DOCUMENTS

CN 201874831 U 6/2011
CN 102162454 A 8/2011
CN 102235358 A 11/2011
CN 102483065 A 5/2012
CN 105370576 A 3/2016
EP 2063122 A1 5/2009
JP 2001280252 A 10/2001
JP 2004204791 A 7/2004
JP 2004316591 A 11/2004
JP 2007205270 A 8/2007
JP 2008128035 A 6/2008
JP 2008190329 A 8/2008
JP 2009299583 A 12/2009
KR 20150083242 A 7/2015

OTHER PUBLICATIONS

International Search Report regarding International Application No. PCT/US2017/023204, dated Jun. 26, 2017.
Written Opinion of the International Searching Authority regarding International Application No. PCT/US2017/023204, dated Jun. 26, 2017.
Office Action regarding Chinese Patent Application No. 201780018582.8, dated Apr. 24, 2019. Translation provided by Unitalen Attorneys at Law.
Office Action regarding Korean Patent Application No. 10-2018-7027032, dated Oct. 16, 2019. Translation provided by KS KORYO International IP Law Firm.

* cited by examiner

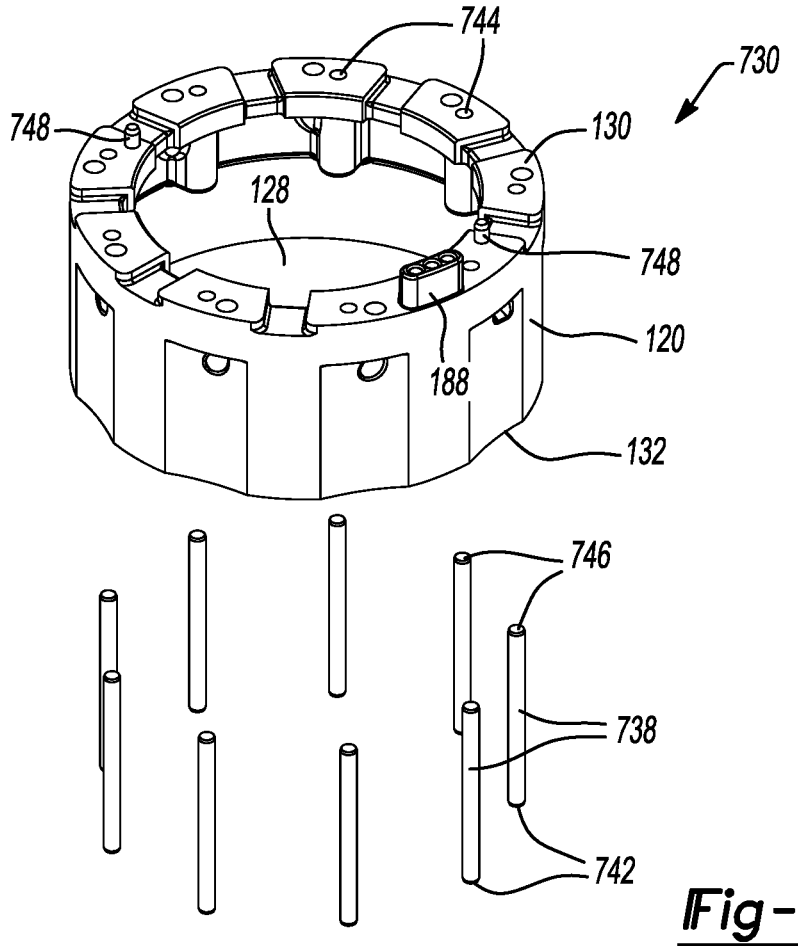
Fig-12A
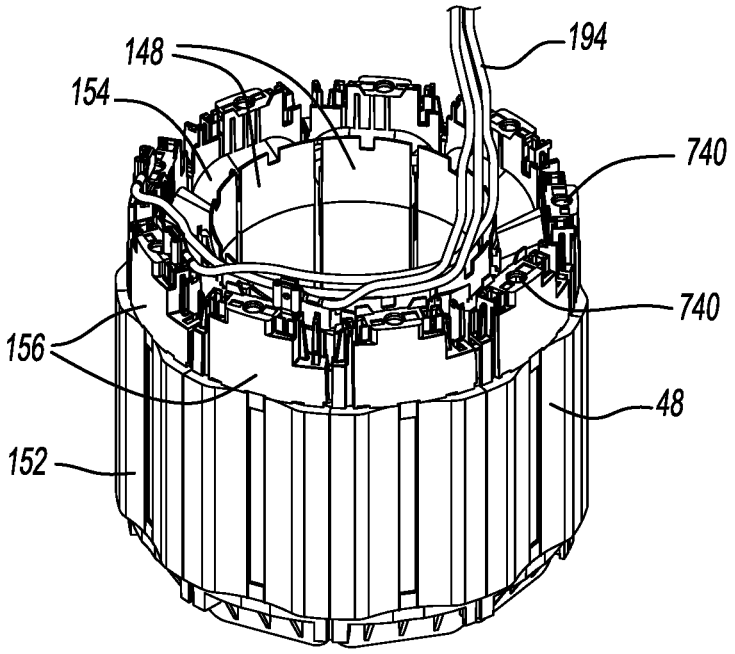

COMPRESSOR OIL SEPARATION AND ASSEMBLY METHOD

CROSS-REFERENCE TO RELATED APPLICATIONS

This application claims the benefit of U.S. Provisional Application No. 62/310,953, filed on Mar. 21, 2016. The entire disclosure of the above application is incorporated herein by reference.

FIELD

The present disclosure relates to separation of lubricant oil and discharge gas in a high-side compressor, and methods of assembling the high-side compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

Oil can be injected into the scroll elements of a high-side compressor to improve sealing and reduce friction between the orbiting and non-orbiting scroll members and improve overall compressor efficiency. Oil can be delivered to the scrolls using a pressure differential between discharge-pressure fluid and suction-pressure fluid, for example. Oil flow is metered and injected into the initial suction pockets where it atomizes and mixes with the gas being compressed. The gas and oil mixture is compressed and then discharged into the shell. Prior to the gas exiting the shell and flowing into the system, oil can be separated from the gas and returned to the compressor oil sump.

SUMMARY

This section provides a general summary of the disclosure, and is not a comprehensive disclosure of its full scope or all of its features.

In one form, the present disclosure may provide a compressor that includes a shell, a compression mechanism, a bearing housing, a shroud, a stator, and a rotor. The compression mechanism may include a scroll member that is rotatably fixed relative to the shell. The bearing housing may rotatably support a drive shaft. The shroud may be rotatably fixed relative to the shell and attached to the bearing housing. The shroud may have an annular body including an inner surface defining a center shroud passage. The stator may be fixed relative to the shell and have an outer surface defining a stator passage. The rotor may be attached to the drive shaft. An outer surface of the rotor and an inner surface of the stator may be spaced apart and define a discharge gap in fluid communication with the center shroud passage and the stator passage. A first continuous passage may extend between a top surface of the scroll member and a bottom surface of the shroud and be in fluid communication with the shroud passage.

In some configurations, the shell of the compressor may define a chamber in fluid communication with the center shroud passage and may contain discharge-pressure working fluid. The compression mechanism may compress working fluid from a suction pressure to a discharge pressure.

In some configurations, the first continuous passage may include a first scroll passage extending between the top surface of the scroll member and a bottom surface of the scroll member. The first continuous passage may further include a first bearing housing passage extending between a top surface of the bearing housing and a bottom surface of the bearing housing. The first bearing housing passage may be in fluid communication with the first scroll passage. The first continuous passage may also include a first shroud passage extending between a top surface of the shroud and the bottom surface of the shroud. The first shroud passage may be in fluid communication with the first bearing housing passage.

In some configurations, the compressor may further comprise a second continuous passage extending between a top surface of the shroud and the top surface of the scroll member. The second continuous passage may be in fluid communication with the center shroud passage. In other configurations, the second continuous passage may include a second shroud passage. The second shroud passage may be in fluid communication with the center shroud passage. The second continuous passage may further include a second bearing housing passage extending between a top surface of the bearing housing and a bottom surface of the bearing housing. The second bearing housing passage may be in fluid communication with the second shroud passage. The second continuous passage may also include a second scroll passage extending between the top surface of the scroll member and a bottom surface of the scroll member. The second scroll passage may be in fluid communication with the second bearing housing passage. In still other configurations, the compressor may comprise a top cap oil separator that is fixed with respect to the shell and has an oil collection surface and a center passage. The center passage may be in fluid communication with the second continuous passage and a compressor discharge port. At least a portion of the oil collection surface may be lined with mesh material.

In some configurations, the outer surface of the rotor may define a surface feature, which may be a plurality of axial scallops extending inward from the outer surface of the rotor. In other configurations, the surface feature may be a plurality of axial fins that extend outward from the outer surface of the rotor.

In some configurations, the inner surface of the stator may define a surface feature, which may be a plurality of axial grooves.

In some configurations, the stator passage may be defined by a space between a first stator segment and a second stator segment of a segmented stator.

In some configurations, the shroud may further comprise a fixture for the stator leads.

In some configurations, the shroud may further comprise an oil drain passage extending from the inner surface of the shroud to an outer surface of the shroud. The oil drain passage may be in fluid communication with a bearing housing oil drain and the stator passage.

In some configurations, at least a portion of the stator is lined with a mesh material.

In some configurations, the compressor may further comprise an upper counterweight that is fixed relative to the rotor. The upper counterweight may have an annular body with a partial cylindrical extrusion extending from a top surface of the annular body. The partial cylindrical extrusion may comprise a counterweight passage extending from an inner surface of the partial cylindrical extrusion to an outer surface of the partial cylindrical extrusion. The partial cylindrical extrusion may also include a lip that is located above the counterweight passage. The inner diameter of the partial cylindrical extrusion at the lip may be smaller than the inner diameter of the partial cylindrical extrusion at a location of the counterweight passage. Rotation of the rotor may cause oil that drips from a bearing of the bearing housing to move upward along the inner surface of the partial cylindrical extrusion, be deflected by the lip, and travel through the counterweight passage. In another configuration, the partial cylindrical extrusion may further comprise a lower portion, an upper portion, and an angled portion that is disposed between the lower portion and the upper portion. The inner diameter of the partial cylindrical extrusion at the upper portion may be larger than the inner diameter of the partial cylindrical extrusion at the lower portion. The partial cylindrical extrusion may have an inner diameter that is smaller at the lip than at the upper portion. The counterweight passage may be disposed on the upper portion of the partial cylindrical extrusion.

In another form, the present disclosure may provide a compressor including a shell, a compression mechanism, a bearing housing, a shroud, a stator, and a rotor. The compression mechanism may include a scroll member that is rotatably fixed relative to the shell. The bearing housing may rotatably support a drive shaft. The stator may be fixed relative to the shell. The stator may have an outer surface defining a stator passage. The stator may include end turn supports having an inner surface. The inner surface may define a center end turn support passage. The rotor may be attached to the drive shaft. An outer surface of the rotor and an inner surface of the stator may be spaced apart and define a discharge gap in fluid communication with the center end turn support passage and the stator passage. The compressor may further include a first continuous passage extending between a top surface of the scroll member and a bottom surface of the end turn supports of the stator. The first continuous passage may be in fluid communication with the stator passage. The compressor may also include a second continuous passage extending between a top surface of the end turn supports of the stator and the top surface of the scroll member. The second continuous passage may be in fluid communication with the center end turn support passage.

In some configurations, the first continuous passage may include a first scroll passage extending between the top surface of the scroll member and a bottom surface of the scroll member. The first continuous passage may further include a first bearing housing passage extending between a top surface of the bearing housing and a bottom surface of the bearing housing. The first bearing housing passage may be in fluid communication with the first scroll passage. The first continuous passage may also include a first end turn support passage extending between a top surface of the end turn supports of the stator and the bottom surface of the end turn supports of the stator. The first end turn support passage may be in fluid communication with the first bearing housing passage In some configurations, the second continuous passage may include a second end turn support passage. The second end turn support passage may be in fluid communication with the center end turn support passage. The second continuous passage may further include a second bearing housing passage extending between a top surface of the bearing housing and a bottom surface of the bearing housing. The second bearing housing passage may be in fluid communication with the second end turn support passage. The second continuous passage may also include a second scroll passage extending between the top surface of the scroll member and a bottom surface of the scroll member. The second scroll passage may be in fluid communication with the second bearing housing passage.

In some configurations, the stator may further include a plurality of segments. Each segment of the plurality of segments may be interlocked to another segment of the plurality of segments.

In another form, the present disclosure may provide a compressor comprising a shell, a compression mechanism, a bearing housing, a shroud, a stator, and a rotor. The compression mechanism may include a scroll member rotatably fixed relative to the shell. The bearing housing may rotatably support a drive shaft. The shroud may be rotatably fixed relative to the shell. The shroud may have an annular body comprising an inner surface defining a center shroud passage. The shroud may further comprise an outer surface. A gap between the outer surface of the shroud and an inner surface of the shell may define a shroud gap. The stator may be fixed relative to the shell. The stator may have an outer surface defining a stator passage. The stator passage may be in fluid communication with the shroud gap. The rotor may be attached to the drive shaft. An outer surface of the rotor and an inner surface of the stator may be spaced apart and may define a discharge gap. The discharge gap may be in fluid communication with the center shroud passage and the stator passage. The compressor may further include a first continuous passage extending between a top surface of the scroll member and a bottom surface of the bearing housing. The first continuous passage may be in fluid communication with the shroud gap. The compressor may also include a second continuous passage extending between the bottom surface of the bearing housing and the top surface of the scroll member. The second continuous passage may be in fluid communication with the center shroud passage.

In some configurations, the first continuous passage may include a first scroll passage extending between the top surface of the scroll member and a bottom surface of the scroll member. The first continuous passage may further include a first bearing housing passage extending between a top surface of the bearing housing and the bottom surface of the bearing housing. The first bearing housing passage may be in fluid communication with the first scroll passage.

In some configurations, the second continuous passage may include a second bearing housing passage extending between a top surface of the bearing housing and the bottom surface of the bearing housing. The second continuous passage may further include a second scroll passage extending between the top surface of the scroll member and a bottom surface of the scroll member. The second scroll passage may be in fluid communication with the second bearing housing passage.

In some configurations, the shroud may comprise metal.

In another aspect, the present disclosure provides a method comprising placing an internal compressor assembly on a base fixture. The internal compressor assembly may include a stator, a shroud, and a bearing housing. The shroud may be fixed relative to the bearing housing and the stator. The method may further comprise aligning an inner circumferential surface of a shell with a radially outermost surface of the internal compressor assembly. The method may further comprise heating the shell and placing the shell around the internal compressor assembly; and allowing the shell to return to ambient temperature, thereby creating a shrink fit between the shell and the internal compressor assembly.

In some configurations, the method may comprise aligning a plurality of alignment pins extending from a top surface of the shroud with a plurality of alignment holes defined by a bottom surface of the bearing housing.

In some configurations, the method may comprise attaching a lower bearing to a lower bearing housing with screws; and adjusting the position of the lower bearing assembly after placement of the shell using the screws.

In some configurations, the method may comprise placing a lower counterweight cover at least partially into a gap between the stator and the rotor, so that an inner surface of the stator contacts an outer surface of the lower counterweight cover, and an outer surface of the rotor contacts an inner surface of the lower counterweight cover.

In some configurations, the method may comprise removing the lower counterweight cover from the gap between the stator and the rotor after placement of the shell.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 12A is an exploded view of a lower compressor assembly of the compressor of FIG. 1;

Corresponding reference numerals indicate corresponding parts throughout the several views of the drawings.

DETAILED DESCRIPTION

Figure 1:
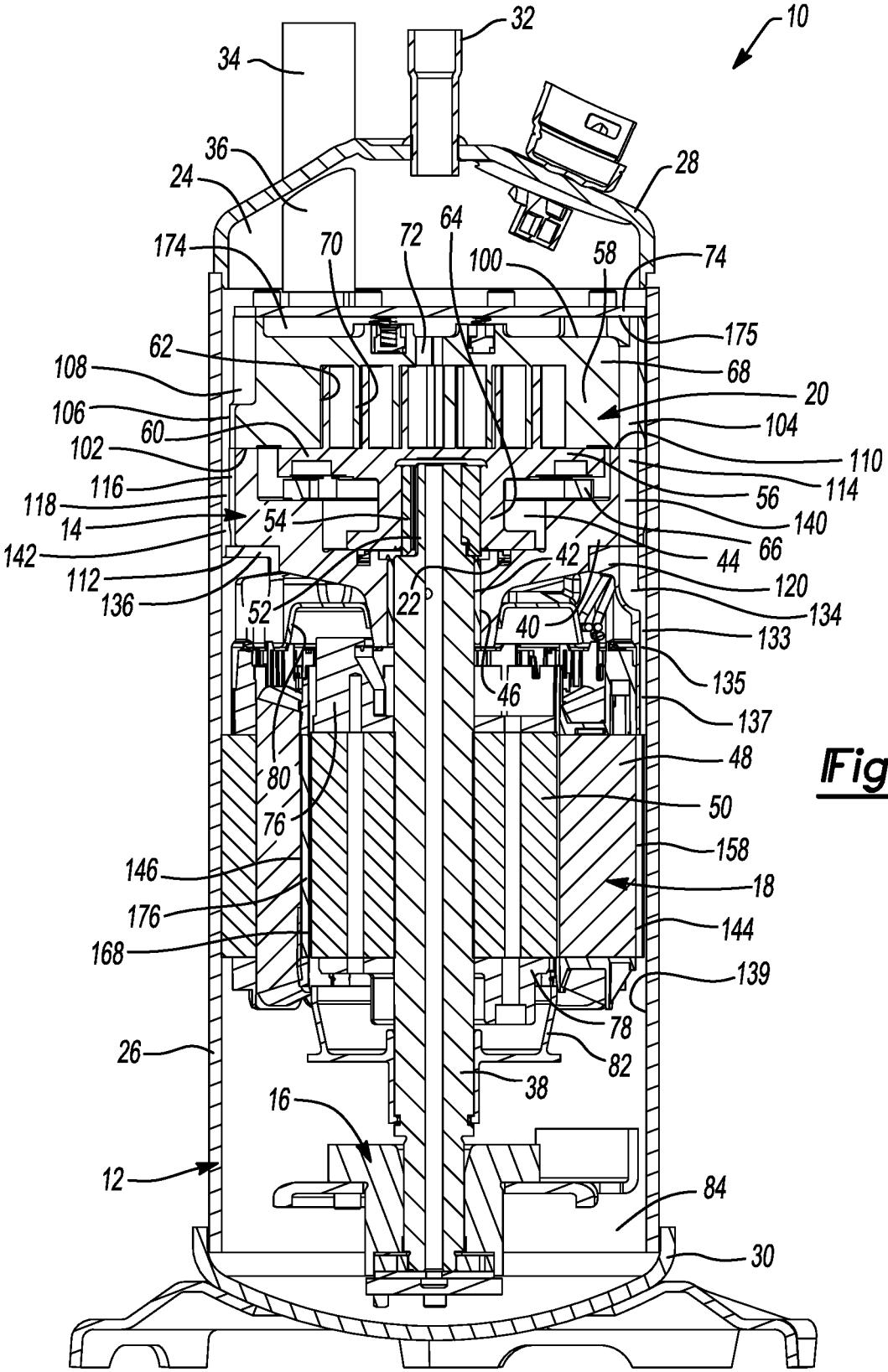
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a shell assembly 12, a main bearing assembly 14, a lower bearing assembly 16, a motor assembly 18, a compression mechanism 20, and a seal assembly 22. The shell assembly 12 may define a high-pressure discharge chamber 24 and may include a cylindrical shell 26, an end cap 28 at an upper end thereof, and a base 30 at a lower end thereof. A discharge tube 32 may be attached to the end cap 28 and is in fluid communication with the discharge chamber 24. The compressor 10 may be a high-side compressor (i.e., the motor assembly 18 and compression mechanism 20 are disposed in the discharge chamber 24). A suction inlet fitting 34 may be attached to shell assembly 12 and may fluidly be connected to the compression mechanism by a suction conduit 36.

Figure 11A:
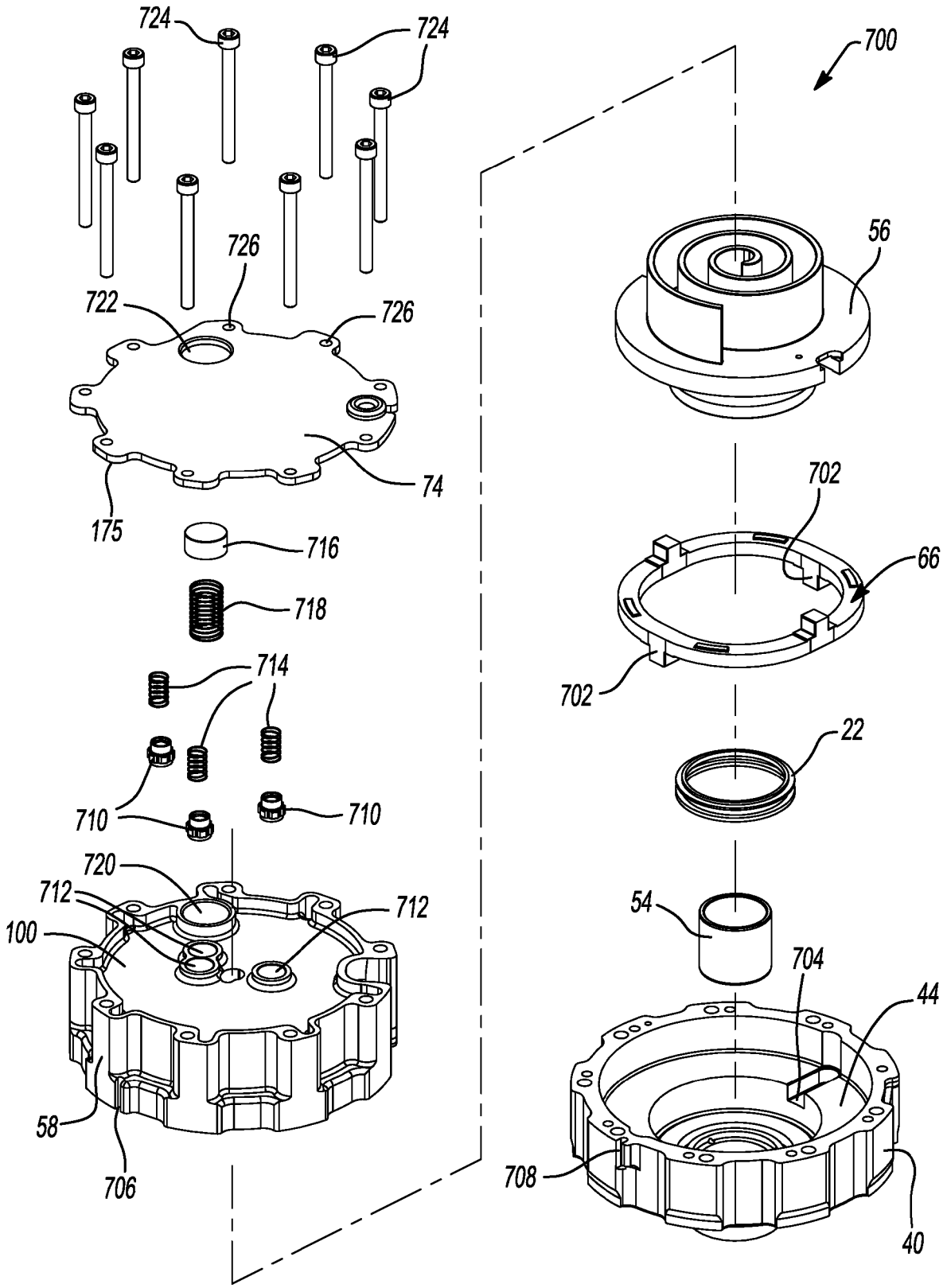
FIG. 11A is an exploded view of an upper compressor assembly of the compressor of FIG. 1.

The main and lower bearing assemblies 14 and 16 may be fixed relative to the shell assembly 12 and may rotatably support respective ends of a drive shaft 38. The main bearing assembly 14 may be an upper bearing assembly and may include a main bearing housing 40 and a main bearing 42. As shown in FIG. 11A, the main bearing housing 40 may be a generally bowl-shaped annular member. Referring back to FIG. 1, the main bearing housing 40 may define a stepped cavity 44 and an aperture 46 in which the main bearing 42 is received and through which the drive shaft 38 extends.

The motor assembly 18 may be disposed within the discharge chamber 24 and may include a motor stator 48 and a rotor 50. The motor stator 48 may be fixed relative to the shell assembly 12. The rotor 50 may be press fit on the drive shaft 38 and may transmit rotational power to the drive shaft 38. The drive shaft 38 may include an eccentric crank pin 52 received in an unloader bushing 54. The crank pin 52 drives the compression mechanism 20.

The compression mechanism 20 may be disposed within the discharge chamber 24 and may include an orbiting scroll 56 and a non-orbiting scroll 58. The orbiting scroll 56 may include an end plate 60 having a spiral wrap 62 extending therefrom. A generally cylindrical hub 64 may project downwardly from the end plate 60. The hub 64 may receive the crank pin 52 and unloader bushing 54. An Oldham coupling 66 may be engaged with the orbiting scroll 56 and the main bearing housing 40 to prevent rotation of the orbiting scroll 56.

The non-orbiting scroll 58 may include an end plate 68 and a spiral wrap 70 projecting downwardly from the end plate 68. The spiral wrap 70 may meshingly engage the spiral wrap 62 of the orbiting scroll 56, thereby creating a series of moving fluid pockets. The fluid pockets defined by the spiral wraps 62 and 70 may decrease in volume as they move from a radially outer position (at a low pressure) to a radially intermediate position (at an intermediate pressure) to a radially inner position (at a high pressure) throughout a compression cycle of the compression mechanism 20. The end plate 68 may include a discharge passage 72 in communication with one of the fluid pockets at the radially inner position and allows compressed working fluid (at the high pressure) to flow into the discharge chamber 24. A scroll cover 74 may be mounted to the end plate 68 of the non-orbiting scroll 58.

The motor assembly 18 may include an upper counterweight 76 and a lower counterweight 78. In one configuration, the upper counterweight 76 and the lower counterweight 78 may be fixed to the rotor 50 to facilitate balanced rotation of the drive shaft 38. An upper counterweight cover 80 may at least partially cover the upper counterweight 78. The upper counterweight cover 80 may be mounted to the main bearing housing 40. A lower counterweight cover 82 may at least partially cover the lower counterweight 78. The lower counterweight cover 82 may be mounted to the drive shaft 38 between the lower counterweight 78 and an oil sump 84.

The non-orbiting scroll 58 may include a top surface 100 and a bottom surface 102. A first scroll passage 104 may extend between the top surface 100 and the bottom surface 102. In some embodiments, there may be a plurality of first scroll passages 104. The first scroll passage 104 may be a hole with a circular cross section. The non-orbiting scroll 58 may include an outer surface 106. A second scroll passage 108 may extend between the top surface 100 and the bottom surface 102. The second scroll passage 108 may be an axial slot defined by the outer surface 106. In some embodiments, the non-orbiting scroll 58 may include a plurality of second scroll passages 108.

The main bearing housing 40 may have a top surface 110 and a bottom surface 112. The main bearing housing 40 may have a first bearing housing passage 114 extending between the top surface 110 and the bottom surface 112. The first bearing housing passage 114 may be a hole having a circular cross section. In some embodiments, the main bearing housing 40 may include a plurality of first bearing housing passages 114. The main bearing housing may include an outer surface 116. A second bearing housing passage 118 may extend between the top surface 110 and the bottom surface 112. The second bearing housing passage 118 may be an axial slot defined by the outer surface 116. In some embodiments, the main bearing housing 40 may include a plurality of second bearing housing passage 118.

Figure 2A:
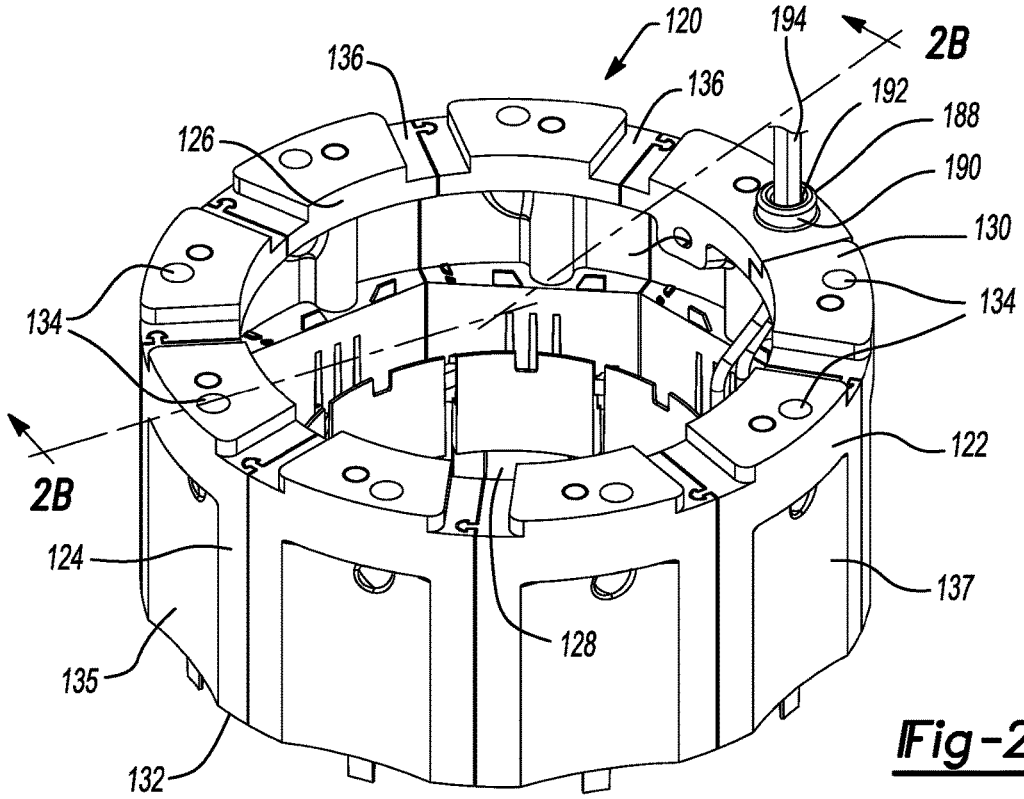
FIG. 2A is a perspective view of a shroud of the compressor of FIG. 1.
Figure 2B:
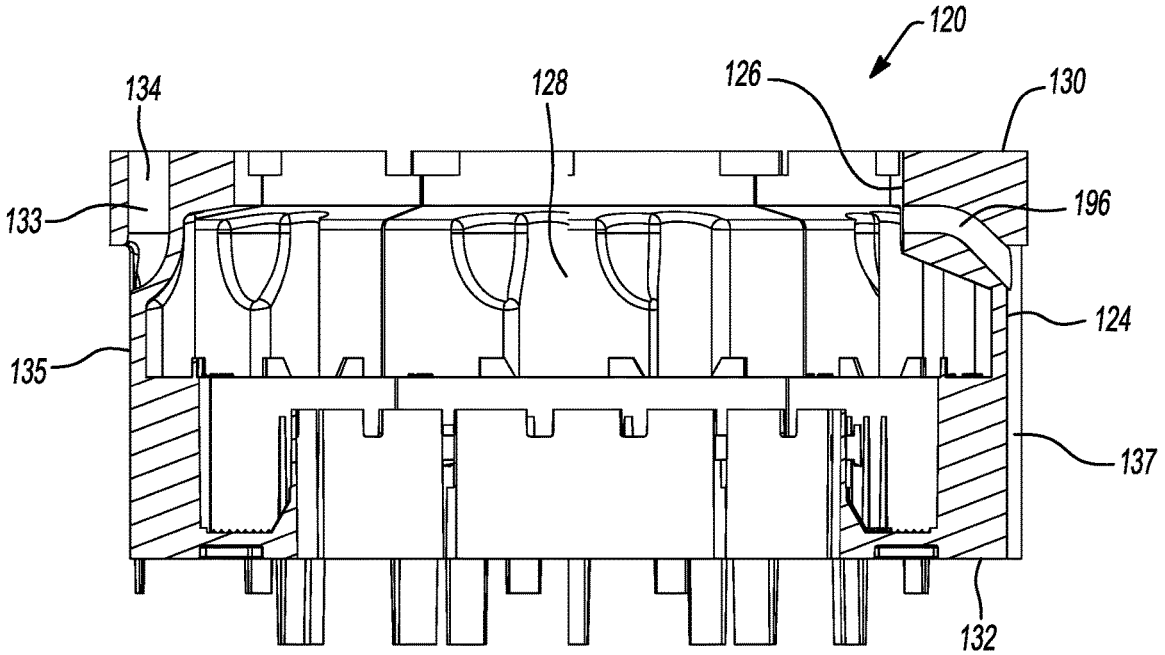
FIG. 2B is a cross-sectional view of the shroud of FIG. 1.

Referring to FIGS. 1, 2A, and 2B, the compressor 10 may further include a shroud 120. The shroud 120 may have an annular body 122 including an outer surface 124 and an inner surface 126. The inner surface 126 may define a center shroud passage 128. The shroud 120 may have a top surface 130 and a bottom surface 132. A first shroud passage 133 may extend between the top surface 130 and the bottom surface 132. The first shroud passage 133 may include both a hole 134 extending from the top surface 130 to the outer surface 124, and an axial slot or gap 135 defined by the outer surface 124, wherein the hole 134 and the axial slot 135 are in fluid communication. The axial slot 135 forms a shroud gap 137 between the outer surface 124 of the shroud 120 and an inner surface 139 of the shell 26. In some embodiments, the shroud 120 may include a plurality of first shroud passages 133. The shroud 120 may include a second shroud passage 136 extending from the center shroud passage 128 to the outer surface 124. The second shroud passage 136 may be a radial slot or depression defined by the top surface 130. In some embodiments, the shroud 120 may include a plurality of second shroud passages 136.

Referring back to FIG. 1, the first scroll passage 104, the first bearing housing passage 114, and the first shroud passage 133 may be in fluid communication and form a first continuous passage 140. The second shroud passage 136, the second bearing housing passage 118, and the second scroll passage 108 may be in fluid communication and define a second continuous passage 142.

Figure 3A:
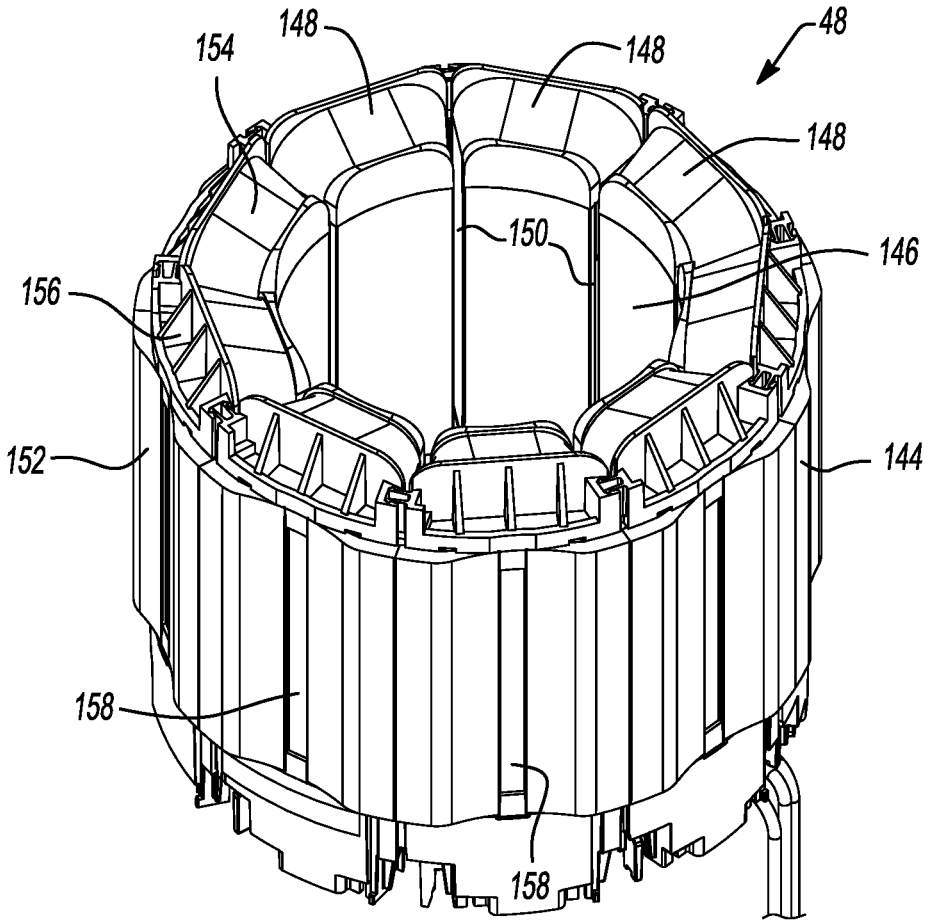
FIG. 3A is a segmented stator according to the principles of the present disclosure.

Referring to FIGS. 1 and 3A, the stator 48 may have an outer surface 144 and an inner surface 146. The stator 48 may be a segmented stator comprising a plurality of segments 148. Circumferential spaces between each segment of the plurality of segments 148 may create axial grooves 150 on the inner surface 146 of the stator 48. The stator 48 may include lamination 152, windings 154, and winding end turn supports 156. The outer surface 144 of the stator 48 may define a plurality of axial flats 158.

In some embodiments, the inner surface 146 of the stator 48 may include a plurality of axial fins (not shown) extending inward toward the rotor 50. The cross-section of the fins may be a variety of shapes, including rectangular, triangular, or semi-circular, for example. The fins may be created as part of the stator lamination 152.

Figure 3B:
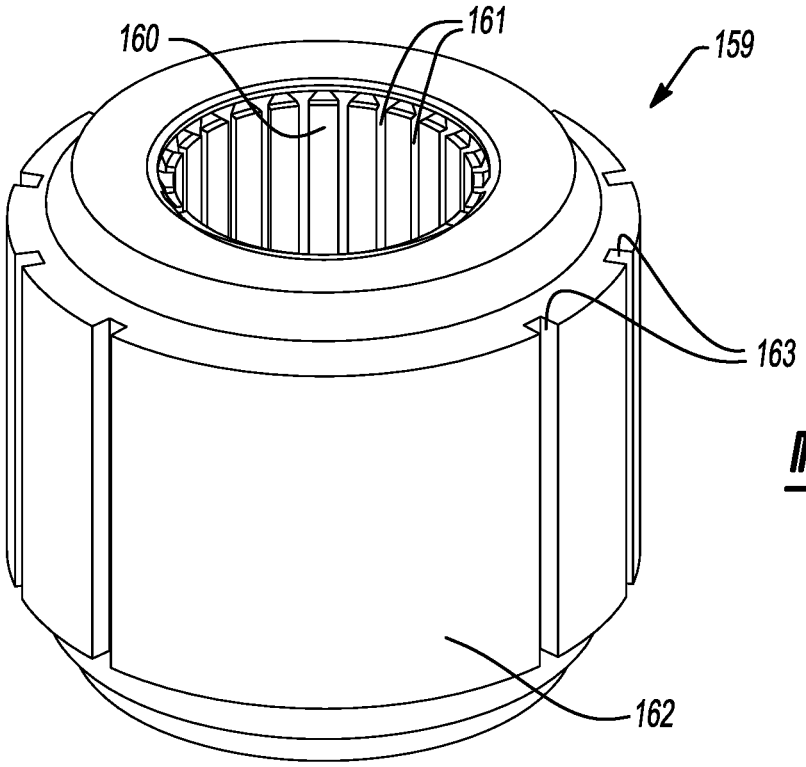
FIG. 3B is a non-segmented stator according to the principles of the present disclosure.

Referring to FIG. 3B, the stator may alternatively be a non-segmented stator 159. An inner surface 160 of the non-segmented stator 159 may define a plurality of axial wire slot openings 161. An outer surface 162 of the non-segmented stator 159 may define a plurality of inwardly-extending axial grooves 163. The inner surface 160 of the non-segmented stator 159 may also include a plurality of inwardly extending axial fins (not shown). The cross-section of the fins may be a variety of shapes, including rectangular, triangular, or semi-circular, for example. The fins may be created by extending winding cell insulation to protrude from the axial wire slot openings 161.

Figure 4A:
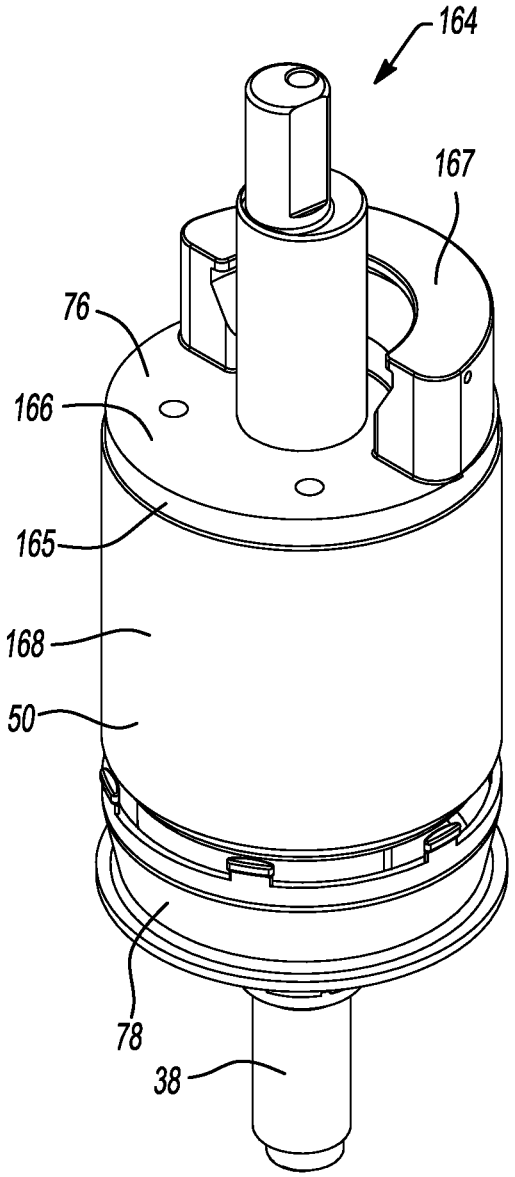
FIG. 4A is a perspective view of a rotor according to the principles of the present disclosure.

Referring to FIGS. 1 and 4A, a rotor assembly 164 may include the drive shaft 38, the rotor 50, the upper counterweight 76, and the lower counterweight 78. The upper counterweight 76 may have a generally annular body 165 with a top surface 166. A partial cylindrical extrusion 167 may extend from the top surface 166 of the annular body 165 of the upper counterweight 76. The rotor 50 may have an outer surface 168.

Figure 4B:
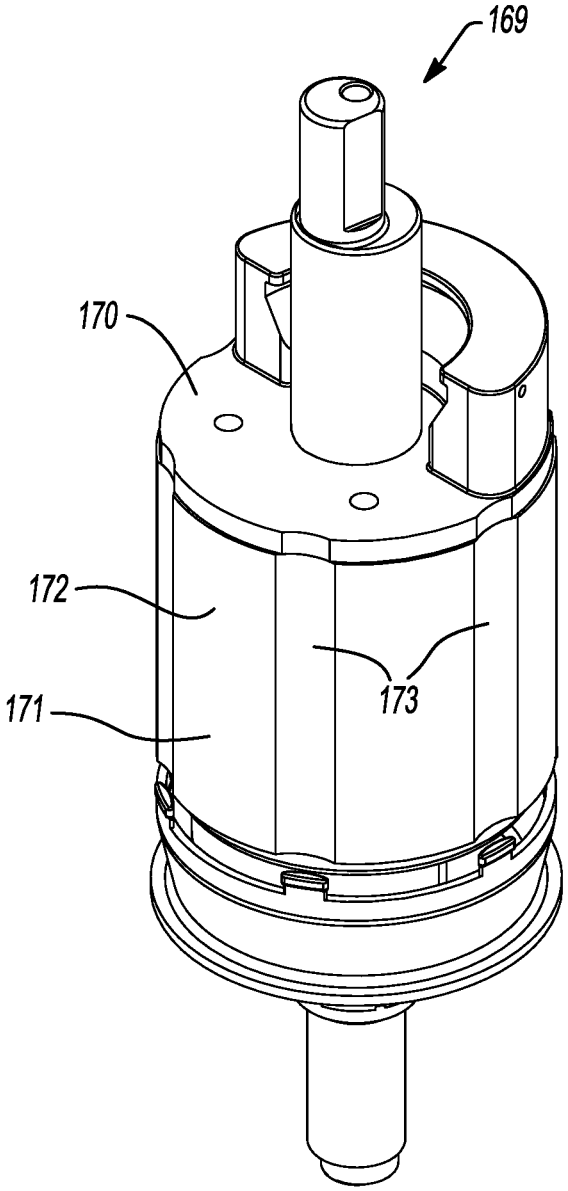
FIG. 4B is a perspective view of a rotor with scallops on the outer surface according to the principles of the present disclosure.

Referring to FIG. 4B, in an alternative embodiment, a rotor assembly 169 may include an upper counterweight 170 and a rotor 171. An outer surface 172 of the rotor 171 may define a plurality of inwardly-extending axial scallops 173. The axial scallops 173 may divert oil outward as the rotor 171 rotates during operation of the compressor, further facilitating separation of oil and gas. The axial scallops 173 may extend into the upper counterweight 170. Although FIG. 4B depicts axial scallops 173, it should be noted that other surface features, such as dimples or grooves could be used and are within the scope of the present disclosure. Alternatively, the outer surface 172 of the rotor 171 may include outwardly-extending fins or bumps (not shown) to divert oil outward during operation. The cross-section of the fins or bumps may be a variety of shapes, including rectangular, triangular, or semi-circular, for example.

Returning to FIG. 1, during operation of the compressor 10 a discharge mixture of gas and oil may exit the compression mechanism 20 at the discharge passage 72. The discharge mixture may flow through a first discharge gap 174 defined by a bottom surface 175 of the scroll cover 74 and the top surface 100 of the non-orbiting scroll 58. The discharge mixture may be routed through the first continuous passage 140, then along the axial flats 158 of the outer surface 144 of the stator 48 to the bottom of the stator 48. The discharge mixture may flow up through a second discharge gap 176 defined by the outer surface 168 of the rotor 50 and the inner surface 146 of the stator 48. Rotation of the rotor 50 when the compressor 10 is operating may cause oil to move outward and contact the inner surface 146 of the stator 48. Oil may collect in the plurality of axial grooves 150 of the inner surface 146 of the stator 48. Referring to FIG. 3B, in the non-segmented stator 159, oil may collect on the plurality of axial wire slot openings 161 of the inner surface 160. Referring to FIG. 3B, oil may also collect on surface features, which may be axial scallops 173, on the outer surface 172 of the rotor 171. Referring back to FIG. 1, at least a portion of the oil may flow down into the oil sump 84 of the compressor 10.

The discharge mixture may continue to flow up through the second discharge gap 176. This flow may provide cooling of the rotor assembly 164 during operation of the compressor 10. At least some of the discharge gas may also flow through the stator windings 154, where oil will collect on the wires and flow down to the oil sump 84. Discharge gas may flow from the second discharge gap 176 through the center passage 128 of the shroud 120 and into the second continuous passage 142. Discharge gas may exit the compressor 10 through the discharge tube 32. Discharge gas routed through the second discharge gap 176 may also provide motor cooling and liquid clearing during flooded start.

Figure 5:
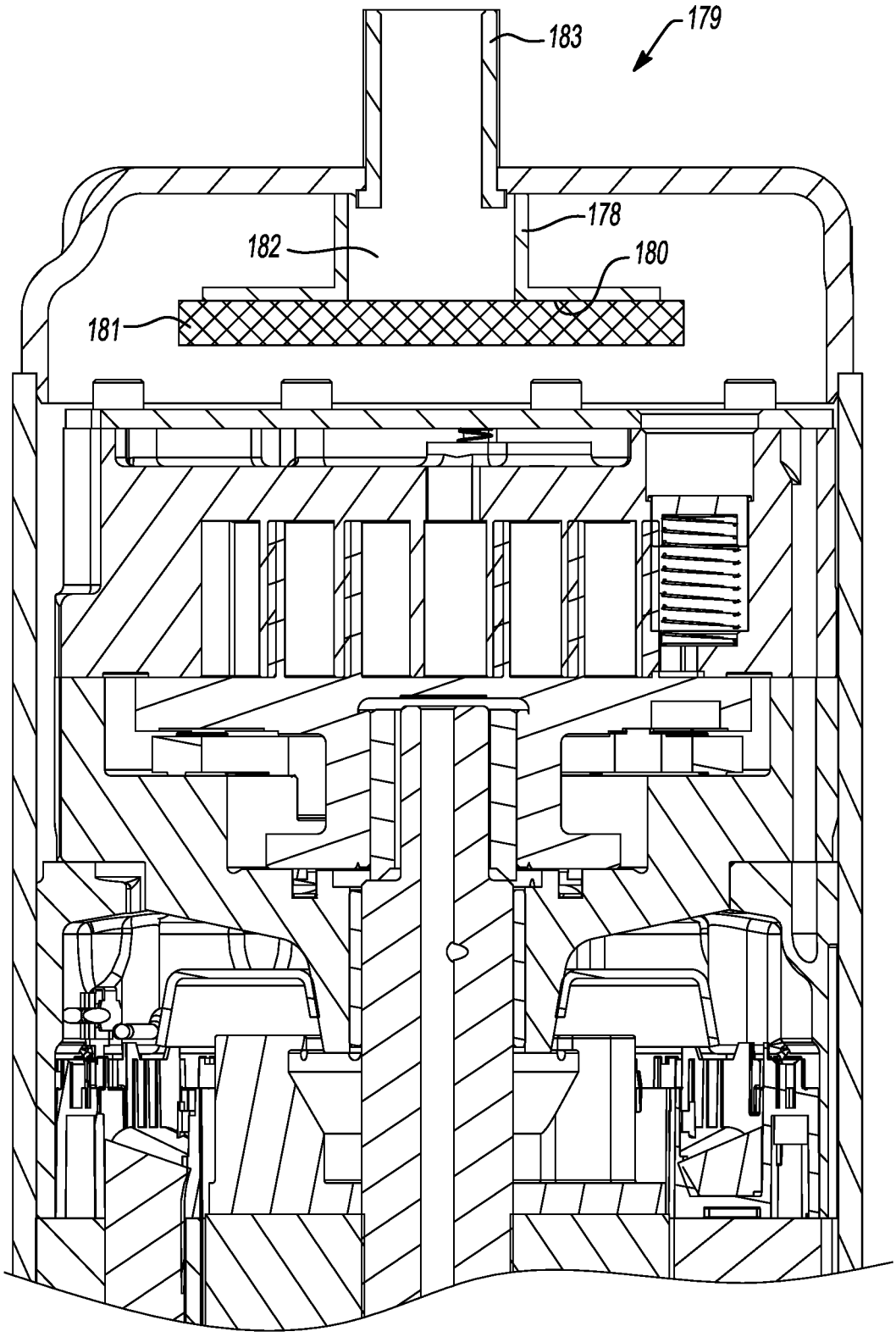
FIG. 5 is a partial cross-sectional view of a compressor with a top cap oil separator according to the principles of the present disclosure.
Figure 6:
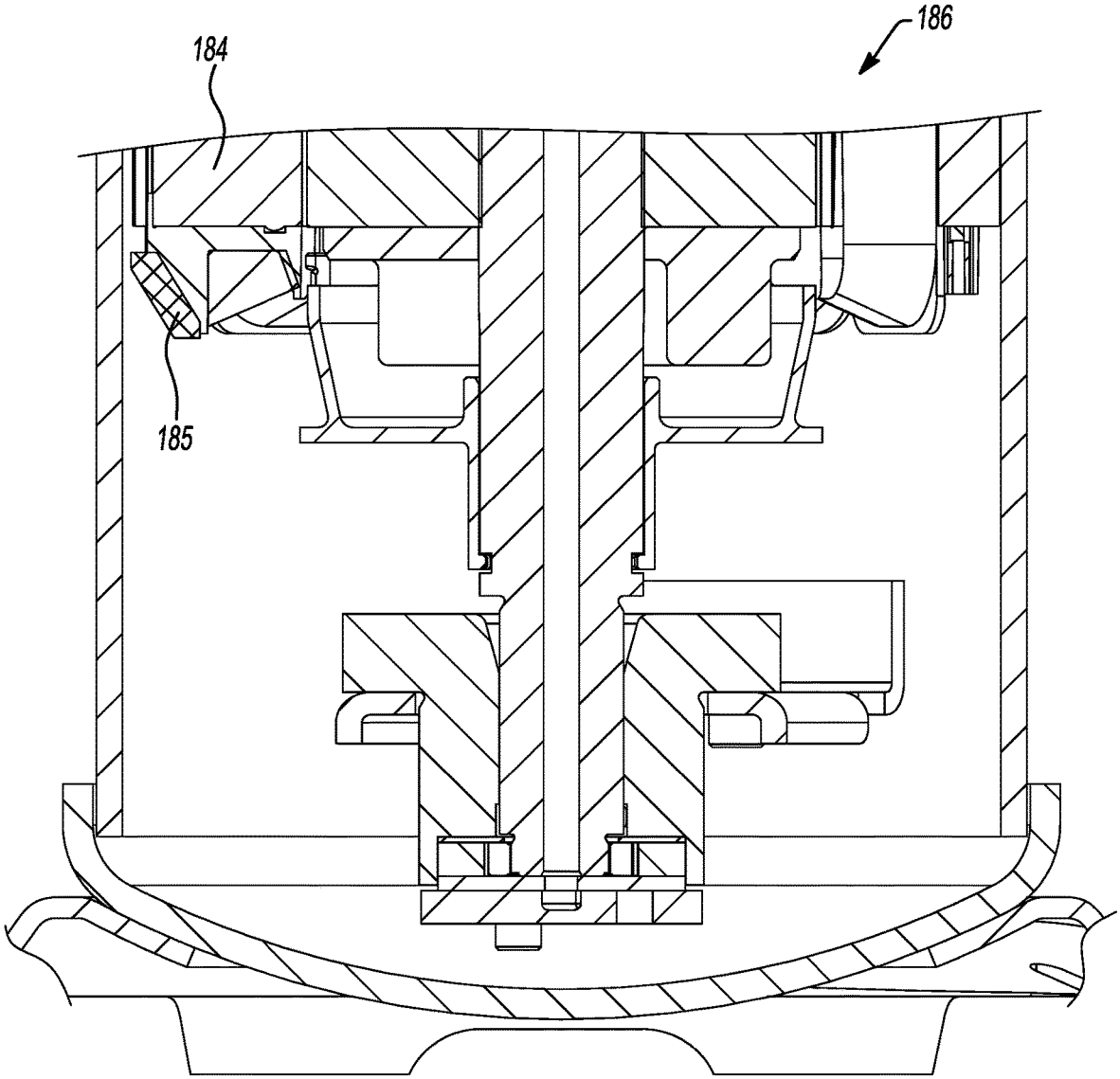
FIG. 6 is a partial cross-sectional view of a compressor with mesh on the bottom portion of the stator according to the principles of the present disclosure.

Referring to FIG. 5, in an alternative embodiment, oil separation may be improved by use of a top cap oil separator 178 on a compressor 179. The top cap oil separator 178 may include an oil separation surface 180 that is lined with a mesh material 181 and a center passage 182 in fluid communication with a discharge tube 183. With reference to FIG. 6, in yet another embodiment, the bottom of a stator 184 may be lined with a mesh material 185 to provide additional oil separation at higher rotor speeds, for example 4500 RPM, during operation of a compressor 186.

Referring back to FIGS. 2A and 2B, the shroud 120 may include a stator lead guide 188. The stator lead guide 188 may extend axially from the top surface 130 of the shroud 120, and may be a raised boss 190 with a passage 192 for the stator leads 194. The stator lead guide 188 may extend into a slot opening in the main bearing housing 40 (shown in FIG. 1). The scroll cover 74 (shown in FIG. 1) may include a grommet (not shown) to hold the stator leads 194 in place away from the top cap weld. The stator lead guide 188 may guide and protect the stator leads 194 during assembly and operation of the compressor 10.

The shroud 120 may further include an oil drain passage 196 extending from the inner surface 126 of the shroud 120 to the outer surface 124 of the shroud 120. The oil drain passage 196 may capture oil from the main bearing 42 and direct it to the outer surface 124 of the shroud 120. The oil drain passage 196 may eliminate the need for an oil drain tube (not shown).

Figure 7A:
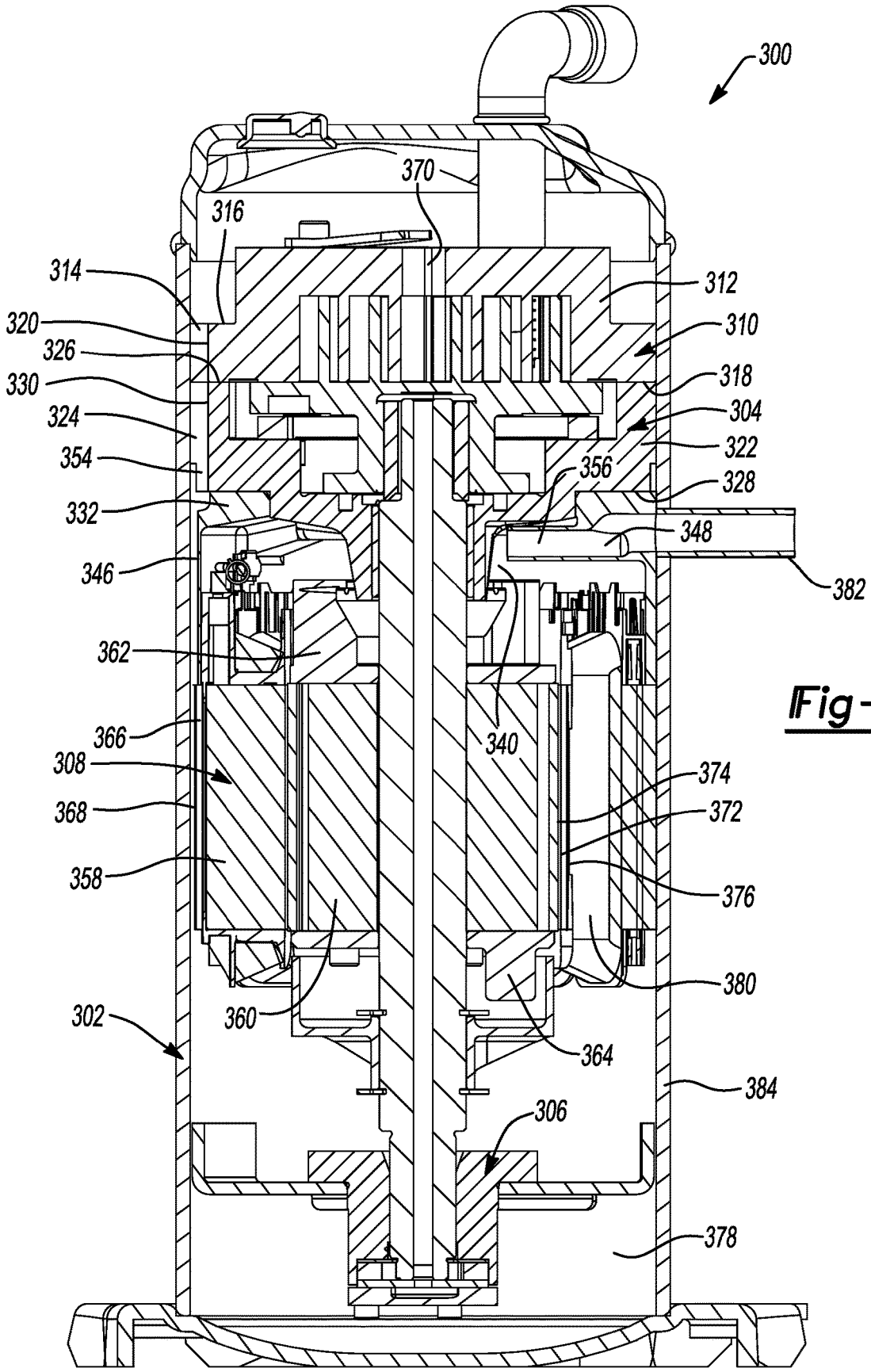
FIG. 7A is a cross-sectional view of a compressor with a side discharge port according to the principles of the present disclosure.

Referring to FIG. 7A, a compressor 300 is provided that may include a shell assembly 302, a main bearing assembly 304, a lower bearing assembly 306, a motor assembly 308, and a compression mechanism 310. The shell assembly 302, main bearing assembly 304, lower bearing assembly 306, motor assembly 308, and compression mechanism 310 may be similar or identical to components 12, 14, 16, 18, and 20, respectively, of compressor 10 discussed above apart from the exceptions discussed below.

The compression mechanism 310 may include a non-orbiting scroll 312. The non-orbiting scroll 312 may include a scroll passage 314 extending between a top surface 316 and a bottom surface 318. The scroll passage 314 may be an axial slot defined by an outer surface 320 of the non-orbiting scroll 312. In some embodiments, the non-orbiting scroll may include a plurality of scroll passages 314.

The main bearing assembly 304 may include a main bearing housing 322. The main bearing housing 322 may include a bearing housing passage 324 extending between a top surface 326 and a bottom surface 328. The bearing housing passage 324 may be an axial slot defined by an outer surface 330 of the main bearing housing 322. In some embodiments, the main bearing housing 322 may include a plurality bearing housing passages 324.

Figure 7B:
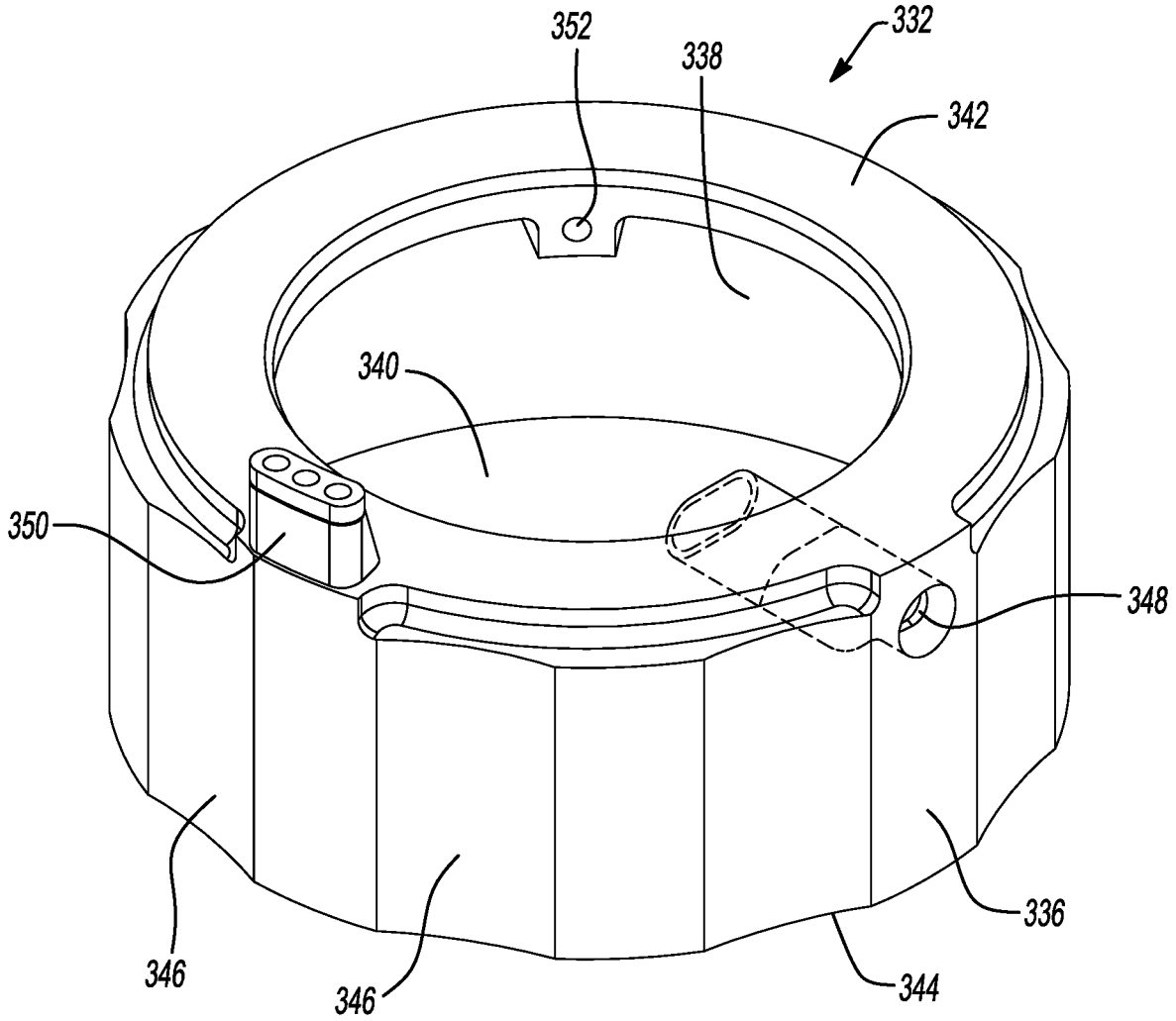
FIG. 7B is a perspective view of a shroud of the compressor of FIG. 7A.

Referring to FIGS. 7A and 7B, the compressor 300 may further include a shroud 332. The shroud 332 may have an annular body 334 including an outer surface 336 and an inner surface 338. The inner surface 338 may define a center shroud passage 340. The shroud 332 may have a top surface 342 and a bottom surface 344. The shroud 332 may include a first shroud passage 346 extending between the top surface 342 and the bottom surface 344. The first shroud passage 346 may be an axial slot or depression. In some embodiments, the shroud 332 may include a plurality of first shroud passages 346. The shroud 332 may include a second shroud passage 348 extending between the inner surface 338 and the outer surface 336. The second shroud passage 348 may be a hole. The shroud 332 may also include a stator lead guide 350. The stator lead guide 350 may be similar or identical to the stator lead guide 188 of compressor 10 discussed above. The shroud 332 may also have an oil drain passage 352 extending between the inner surface 338 and the outer surface 336. The oil drain passage 352 may be similar or identical to the oil drain passage 196 of compressor 10 discussed above.

The scroll passage 314, the bearing housing passage 324, and the first shroud passage 346 are in fluid communication and form a first continuous passage 354. The center shroud passage 340 and the second shroud passage 348 are in fluid communication and define a second continuous passage 356.

Referring back to FIG. 7A, the motor assembly 308 may include a stator 358, a rotor 360, an upper counterweight 362, and a lower counterweight 364. The stator 358, rotor 360, upper counterweight 362, and lower counterweight 364 may be similar or identical to the components 48, 50, 76, and 78, respectively, discussed above with respect to compressor 10, aside from the exceptions discussed below. The stator 358 may include an outer surface 366 defining an axial passage 368. In some embodiments, the stator 358 may include a plurality of axial passages 368.

During operation of the compressor 300, a discharge mixture of gas and oil may exit the compression mechanism 310 at a discharge passage 370 of the compression mechanism 310. The discharge mixture may flow over the top surface 316 of the non-orbiting scroll 312. The discharge mixture may be routed through the first continuous passage 354 and the axial passage 368 of the stator 358. The discharge mixture may flow up through a discharge gap 372 defined by an outer surface 374 of the rotor 360 and an inner surface 376 of the stator 358. Rotation of the rotor 360 when the compressor 300 is operating may cause oil to move outward and contact the inner surface 376 of the stator 358. The oil may flow down to an oil sump 378 of the compressor 300. At least some of the discharge mixture may flow up through windings 380 of the stator 358, where oil may collect on the windings 380 and drip down to the oil sump 378. The discharge mixture may continue to flow up through the discharge gap 372 and the second continuous passage 356. The discharge mixture may exit the compressor 300 through a discharge tube 382 that is mounted to a cylindrical body 384 of the shell assembly 302.

Figure 8:
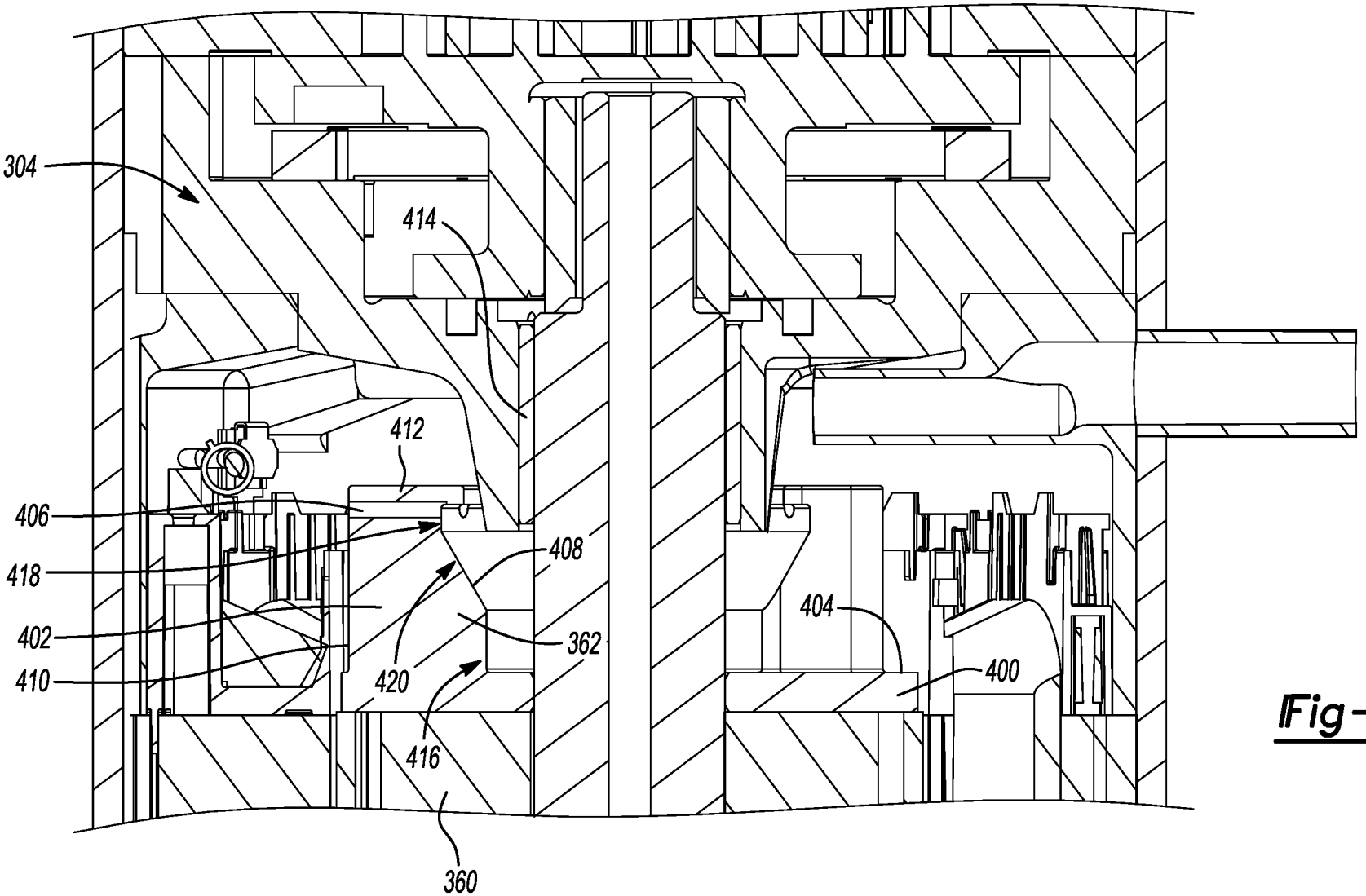
FIG. 8 is a partial cross-sectional view of a compressor according to the principles of the present disclosure showing an upper counterweight with an oil passage.

Referring to FIG. 8, the upper counterweight 362 may be fixed relative to the rotor 360. The upper counterweight 362 may have an annular body 400 with a partial cylindrical extrusion 402 extending upward from a top surface 404 of the annular body 400. The partial cylindrical extrusion 402 may have a counterweight passage 406 extending between an inner surface 408 of the partial cylindrical extrusion 402 and an outer surface 410 of the partial cylindrical extrusion 402. The partial cylindrical extrusion 402 may also have a lip 412 located above the counterweight passage 406. The diameter of the partial cylindrical extrusion 402 at the lip 412 may be smaller than the diameter of the partial cylindrical extrusion 402 at the counterweight passage 406. During operation of the compressor 300, oil may drip from a main bearing 414 of the main bearing assembly 304. Rotation of the rotor 360 may cause oil from the main bearing 414 to move upward along the inner surface 408 of the partial cylindrical extrusion 402, be deflected by the lip 412, and travel through the counterweight passage 406.

In some embodiments, the partial cylindrical extrusion 402 of the upper counterweight 362 may further include a lower portion 416, an upper portion 418, and an angled portion 420 disposed between the lower portion 416 and the upper portion 418. The upper portion 418 may have a diameter that is greater than the diameter of the lower portion 416. The lip 412 may have a diameter that is smaller than the diameter of the upper portion 418. The counterweight passage 406 may be disposed on the upper portion 418 of the partial cylindrical extrusion 402. The use of upper counterweight 362 is not limited to compressor 300. Use of the upper counterweight 362 with other compressors, such as compressor 10, is contemplated and is within the scope of the present disclosure.

Figure 9A:
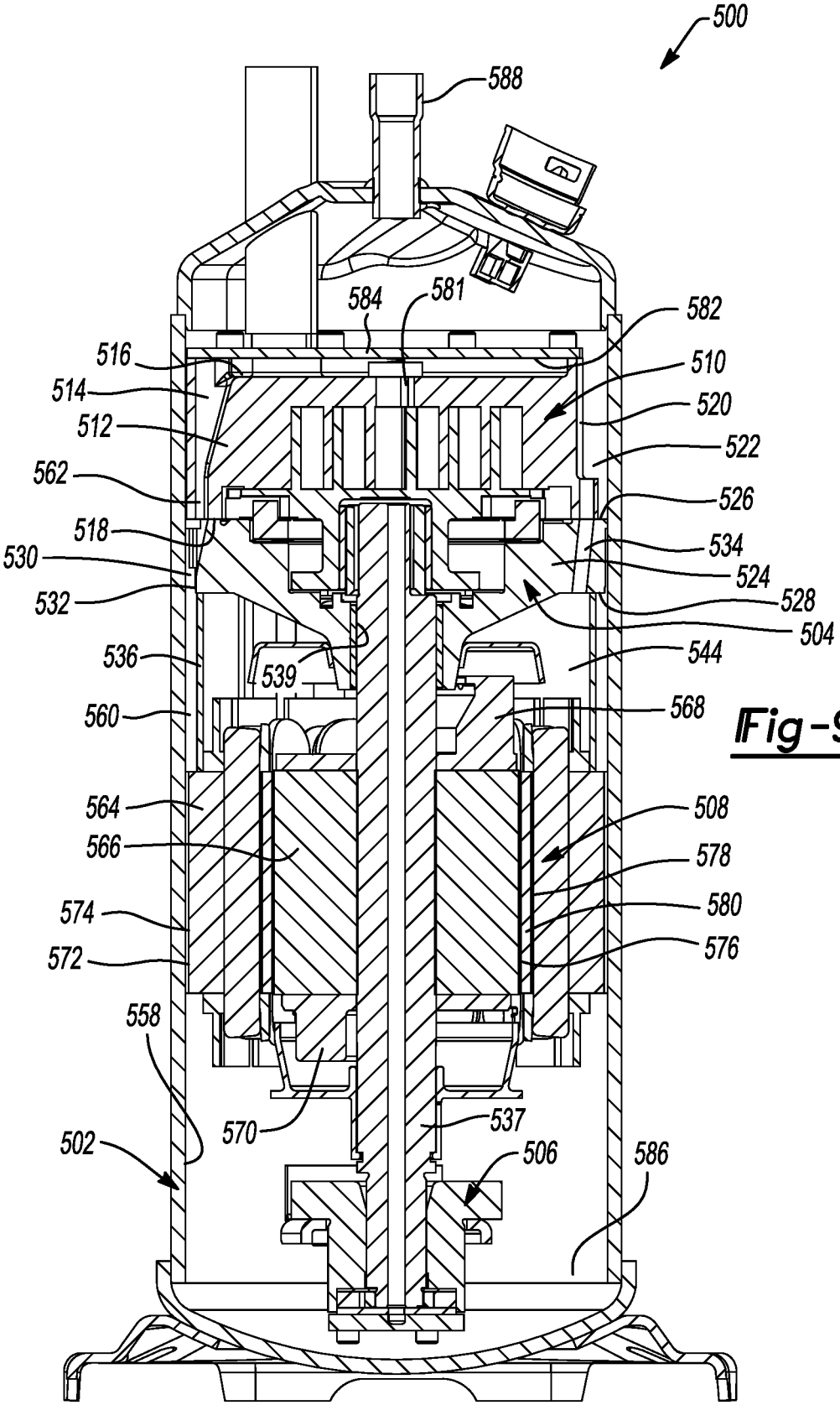
FIG. 9A is a cross-sectional view of a compressor with a thin-walled shroud according to the principles of the present disclosure.

Referring to FIG. 9A, a compressor 500 is provided that may include a shell assembly 502, a main bearing assembly 504, a lower bearing assembly 506, a motor assembly 508, and a compression mechanism 510. The shell assembly 502, main bearing assembly 504, lower bearing assembly 506, motor assembly 508, and compression mechanism 510 may be similar or identical to components 12, 14, 16, 18, and 20, respectively, of compressor 10 discussed above apart from the exceptions discussed below.

The compression mechanism 510 may include a non-orbiting scroll 512. The non-orbiting scroll 512 may include a first scroll passage 514 extending between a top surface 516 and a bottom surface 518. The first scroll passage 514 may be a cored passage. In some embodiments, the non-orbiting scroll 512 may include a plurality of first scroll passages 514. The non-orbiting scroll 512 may further include an outer surface 520. The non-orbiting scroll 512 may include a second scroll passage 522 extending between the top surface 516 and the bottom surface 518. The second scroll passage 522 may be an axial slot or depression. In some embodiments, the non-orbiting scroll 512 may include a plurality of second scroll passages 522.

Figure 9B:
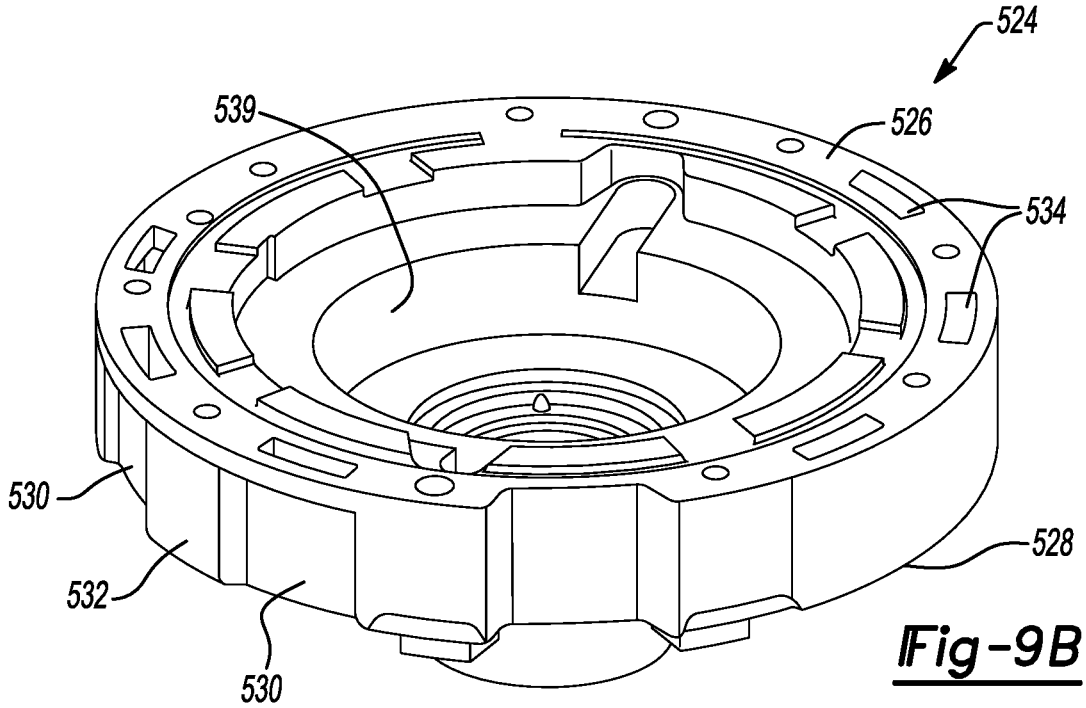
FIG. 9B is a perspective view of a main bearing housing of the compressor of FIG. 9A.

The main bearing assembly 504 may include a main bearing housing 524. Referring to FIG. 9B, the main bearing housing 524 may include a top surface 526 and a bottom surface 528. A drive shaft 537 (FIG. 9A) extends through a central opening 539 in the bearing housing 524. The central opening 539 extends axially through the entire bearing housing 524. A first bearing housing passage 530 may extend between the top surface 526 and the bottom surface 528. The first bearing housing passage 530 may be an axial slot defined by an outer surface 532 of the main bearing housing 524. The first bearing housing passage 530 may be in fluid communication with the first scroll passage 514. In some embodiments, the main bearing housing 524 may include a plurality of first bearing housing passages 530. A second bearing housing passage 534 may extend between the top surface 526 and the bottom surface 528. The second bearing housing passage 534 may be a cored passage. The second bearing housing passage 534 may be in fluid communication with the second scroll passage 522. In some embodiments, the main bearing housing 524 may include a plurality of second bearing housing passages 534.

Figure 9C:
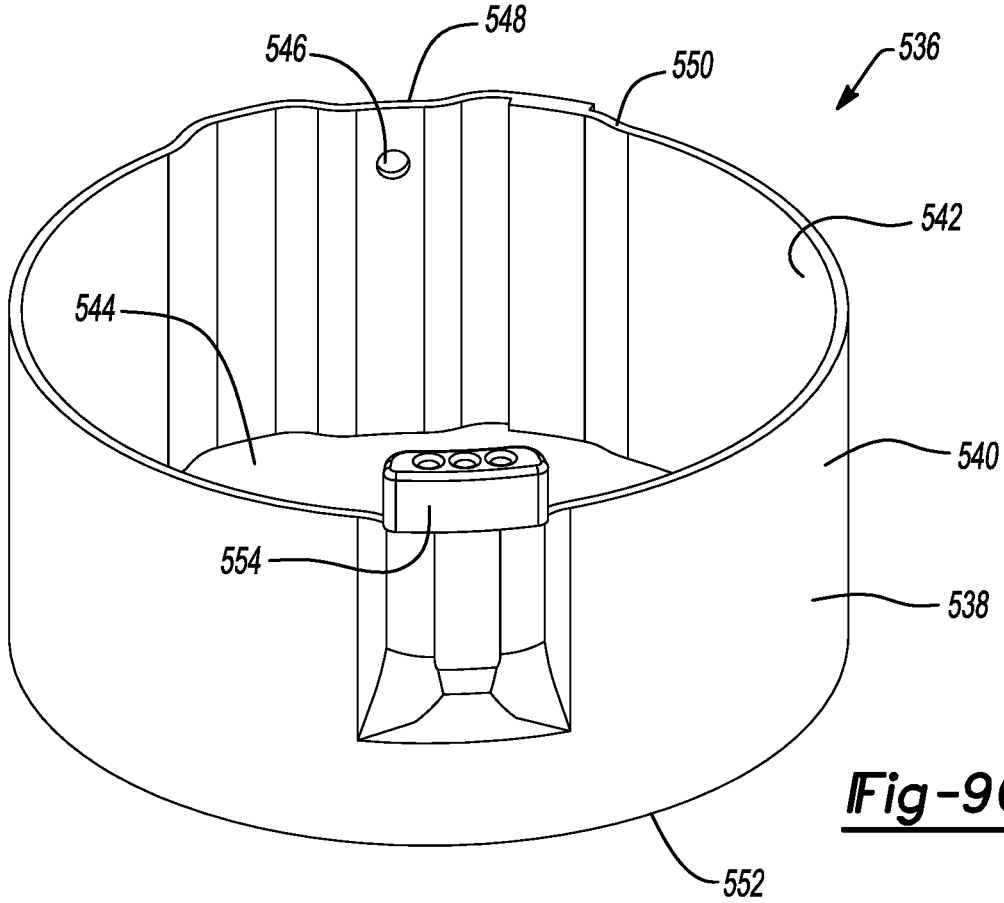
FIG. 9C is a perspective view of a thin-walled shroud of the compressor of FIG. 9A.

Referring to FIGS. 9A and 9C, the compressor 500 may further include a shroud 536 that is fixed with respect to the shell assembly 502. The shroud 536 may be thin-walled. In some forms, the shroud 536 may comprise metal, and may be constructed from sheet stock, cast metal, or powder metal. The shroud 536 may have a generally annular body 538 with an outer surface 540 and an inner surface 542. The inner surface 542 may define a center passage 544. The shroud 536 may further include an oil drain hole 546 extending between the outer surface 540 and the inner surface 542. The oil drain hole 546 may be located in an axial slot or depression 548 defined by the outer surface 540 and extending between a top surface 550 and a bottom surface 552. The oil drain hole 546 may be in fluid communication with an oil drain passage on the main bearing housing 524 (shown in FIG. 9A). The shroud 536 may also include a grommet 554 for stator lead wires (not shown). A gap between the outer surface 540 of the shroud 536 and an inner surface of a cylindrical shell 558 of the shell assembly 502 may define a shroud passage 560 (shown in FIG. 9A).

The first scroll passage 514 and the first bearing housing passage 530 may form a first continuous passage 562. The first continuous passage 562 may be in fluid communication with the shroud passage 560.

The motor assembly 508 may include a stator 564, a rotor 566, an upper counterweight 568, and a lower counterweight 570. The stator 564, rotor 566, upper counterweight 568, and lower counterweight 570 may be similar or identical to the components 48, 50, 76, and 78, respectively, discussed above with respect to compressor 10, aside from the exceptions discussed below. The stator 564 may include an outer surface 572 defining an axial passage 574. The axial passage 574 of the stator 564 may be in fluid communication with the shroud passage 560. An outer surface 576 of the rotor 566 and an inner surface 578 of the stator 564 may be spaced apart and define a discharge gap 580. The discharge gap 580 may be in fluid communication with the axial passage 574 of the stator 564 and the center passage 544 of the shroud 536.

During operation of the compressor 500, a discharge mixture of gas and oil may exit the compression mechanism 510 through a discharge passage 581 in the non-orbiting scroll 512. The discharge mixture may flow between a bottom surface 582 of a scroll cover 584 and down through the first continuous passage 562. The discharge mixture may continue to flow down the axial passage 574 of the stator 564 and up through the discharge gap 580. Rotation of the rotor 566 may cause the discharge mixture to separate into oil and gas. Oil may collect on the inner surface 578 of the stator 564 and drip down to an oil sump 586.

The discharge mixture may continue to flow up through the second bearing housing passage 534 and then through the second scroll passage 522. The discharge mixture may flow out of the compressor 500 through a discharge tube 588.

Figure 10B:
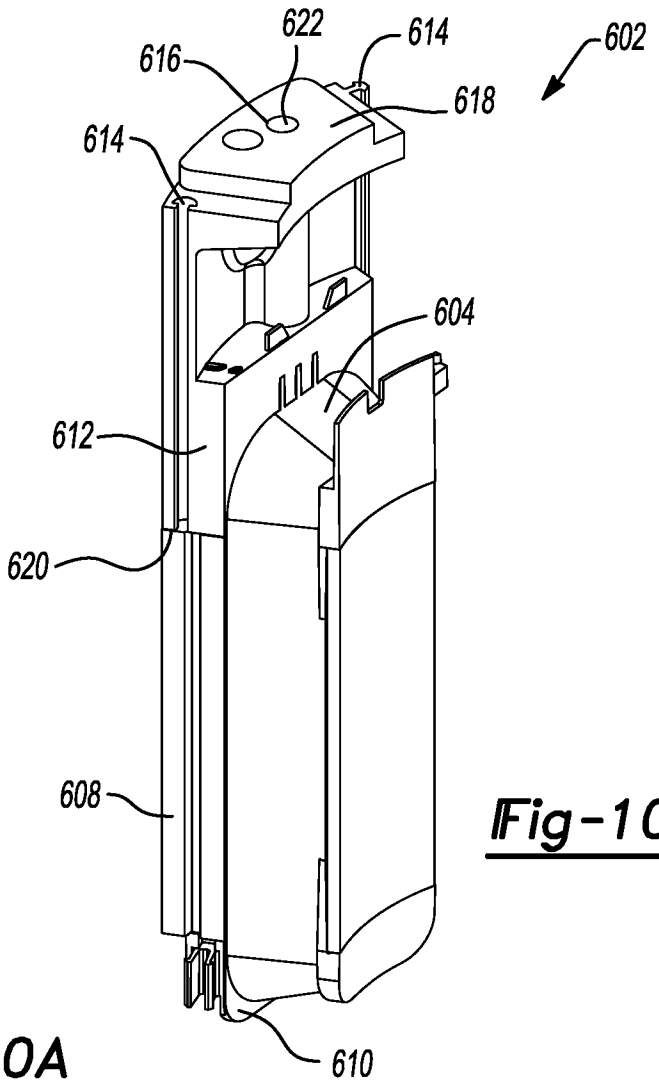
FIG. 10B is a perspective view of a single segment of the stator of FIG. 10A.
Figure 10A:
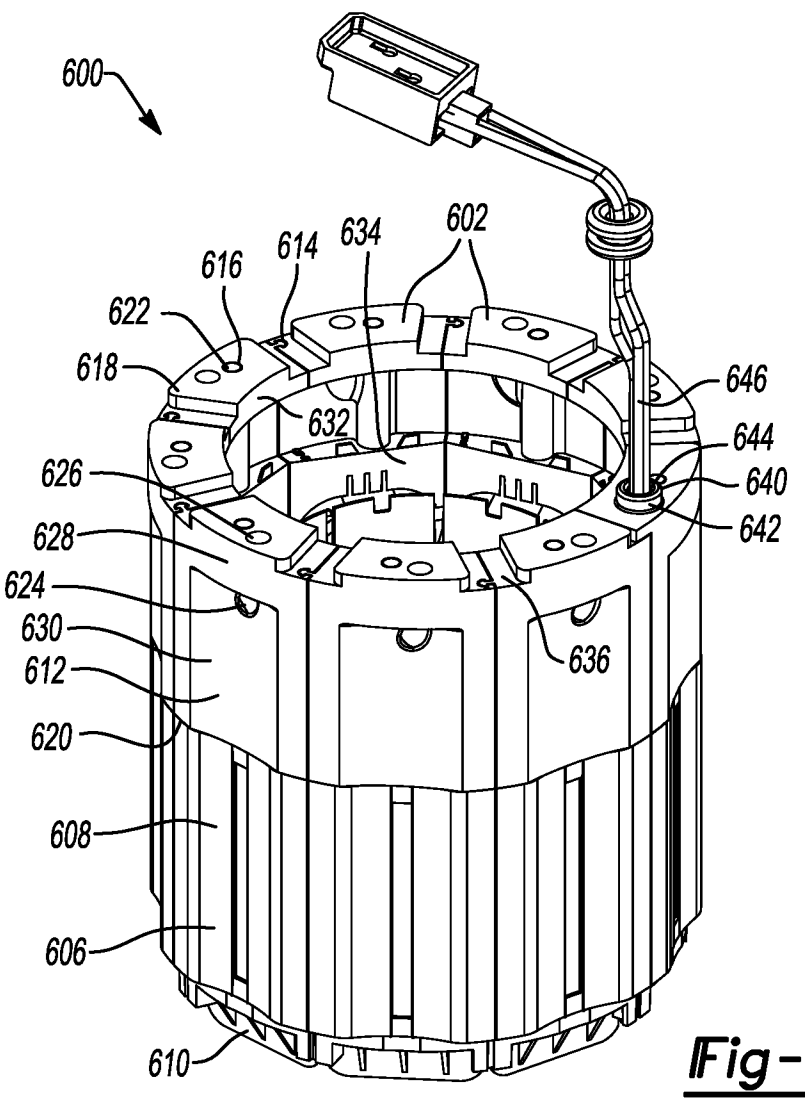
FIG. 10A is a perspective view a stator for a compressor including end to supports configured to replace a shroud member according to the principles of the present disclosure.

Referring to FIGS. 10A and 10B, a stator 600 is provided that includes a plurality of segments 602. The number of segments 602 may be nine. The stator 600 may include windings 604, lamination 606, a core 608, a bottom winding support 610, and a top winding support 612. The top winding support 612 of each segment 602 may include locking features 614 to connect segments together. Each segment 602 may include a first hole 616 extending between a top surface 618 of the top winding support 612 to the bottom 620 of the top winding support 612. The bottom 620 of the top winding support 612 may be in contact with the lamination 606. A pin 622 may pass through the first hole 616 and contact the lamination 606. The top end support 612 may include a plurality of first holes 616 and pins 622. The pins 622 may comprise steel and may provide rigid support for each stator segment 602.

The top winding support 612 of the stator 600 may include a first passage 624 extending between the top surface 618 of the end turn supports 612 and the bottom 620 of the top winding support 620. The first passage 624 may include a second hole 626 extending between the top surface 618 of the end turn supports 612 and an outer surface 628 of the end turn supports 612. The first passage 624 may further include a depression 630 defined by the outer surface 628 of the end turn supports 612. The second hole 626 and the depression 630 may be in fluid communication. The top winding support 612 may further include an inner surface 632 that defines a center passage 634 when the stator 600 is assembled. The stator 600 may also include a second passage 636. The second passage 636 may be a radial slot or depression. The first passage 624, center passage 634, and second passage 636 of the top winding support 612 may be similar or identical to the first shroud passage 133, center passage 128, and second shroud passage 136 of the shroud 120 of compressor 10.

The top winding support 612 may further include a stator lead guide 640. The stator lead guide 640 may extend axially from the top surface 618 of the top winding support 612, and may be a raised boss 642 with a passage 644 for stator leads 646. The top winding support 612 may also include an oil drain passage (not shown) extending between the inner surface 632 of the top winding support and the outer surface 628 of the top winding support. The stator lead guide 640 and the oil drain passage of the top winding support 612 of stator 600 may be similar or identical to the stator lead guide 188 and the oil drain passage 196 of the shroud 120 of compressor 10. The stator 600 may be used to replace the stator 48 and the shroud 120 of compressor 10, by way of non-limiting example.

Figure 11B:
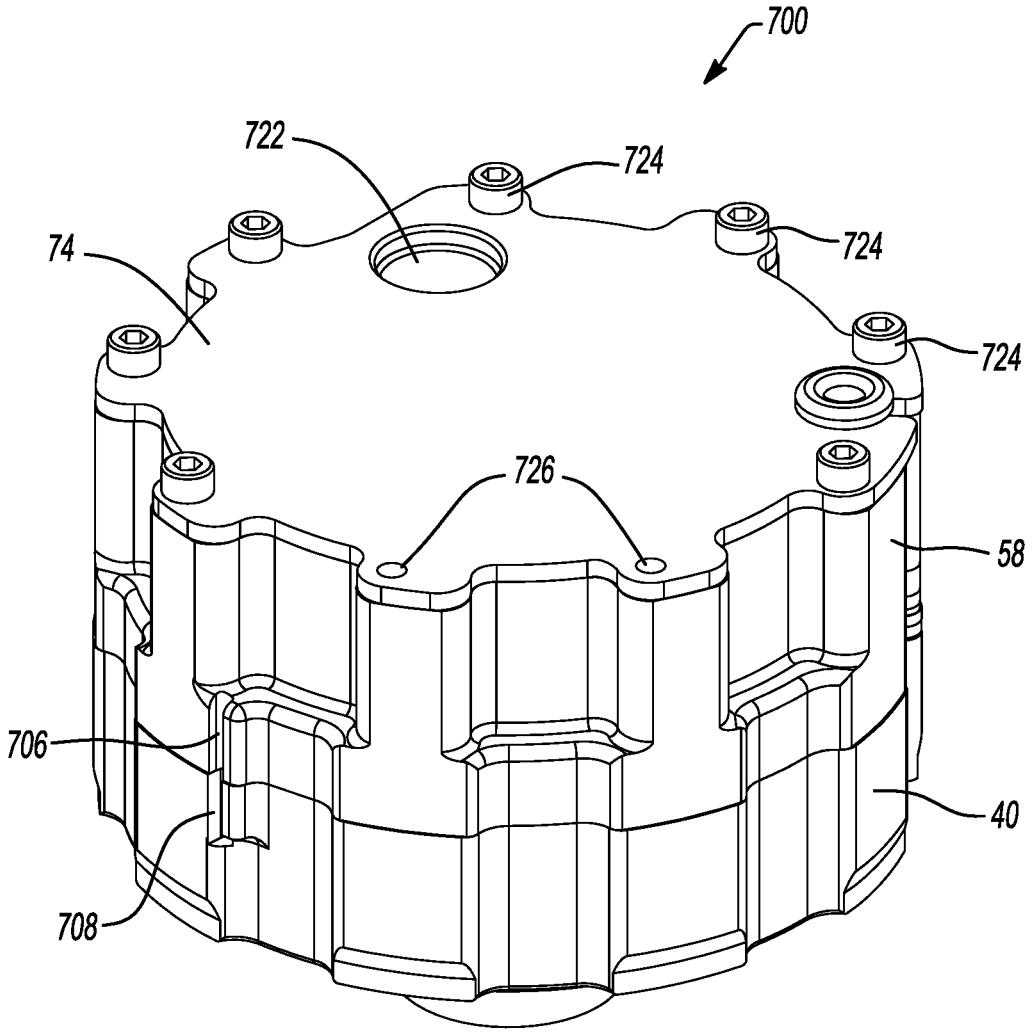
FIG. 11B is an assembled view of an upper compressor assembly of the compressor of FIG. 1.

A method of assembly for compressor according to the teachings of the present disclosure is also provided. Although the assembly method is discussed with reference to the compressor 10 of FIG. 1, the method may be used for any of the compressors of the present disclosure. Referring to FIGS. 11A and 11B, an upper compressor assembly 700 is shown. The unloader bushing 54, seal assembly 22, and Oldham coupling 66 may be placed inside the stepped cavity 44 of the main bearing housing 40. The Oldham coupling 66 may be placed inside the main bearing housing 40 so that downwardly-extending keys 702 of the Oldham coupling 66 engage Oldham key slots 704 of the main bearing housing 40. The orbiting scroll 56 may be placed inside the main bearing housing 40. Angular alignment features 706 and 708 on the non-orbiting scroll 58 and the main bearing housing 40 may be axially-aligned and the non-orbiting scroll 58 may be placed on top of the main bearing housing 40. An assembly fixture (not shown) may be used to align the main bearing housing 40 and non-orbiting scroll 58.

Three variable volume ratio ("VVR") valves 710 may be mounted in counter-bored holes 712 in the top surface 100 of the non-orbiting scroll 58. VVR valves 710 may reduce dead volume between valve seat and scroll base surface to improve efficiency of the compressor. Additionally, this valve design offers several advantages over conventional reed values. It may be easier to assemble because it requires no valve fasteners, eliminating the need for tapered holes. Furthermore, it is more compact than reed valves. This space-saving feature allows for the addition of a greater quantity of valves that can provide a broader scroll built in volume range. In some embodiments, helical valve springs 714 could be attached to the VVR valves 710 to create a captive assembly. Other features, such as enhanced vapor injection ("EVI"), may also be incorporated. A suction valve 716 and spring 718 are mounted in a counter bored suction valve hole 720 on the top surface 100 of the non-orbiting scroll 58.

The scroll cover 74 may be aligned above the non-orbiting scroll 58 so that a suction valve hole 722 of the scroll cover 74 is aligned with the suction valve 716. The scroll cover 74 may be placed on top of the non-orbiting scroll 58 so that the bottom surface 175 of the scroll cover 74 contacts the top surface of the non-orbiting scroll 58, and the bottom surface 175 of the scroll cover 74 retains the VVR valves 710. The scroll cover 74 may be secured with a plurality of bolts 724 that extend through a plurality of holes 726 in the scroll cover 74.

Figure 12C:
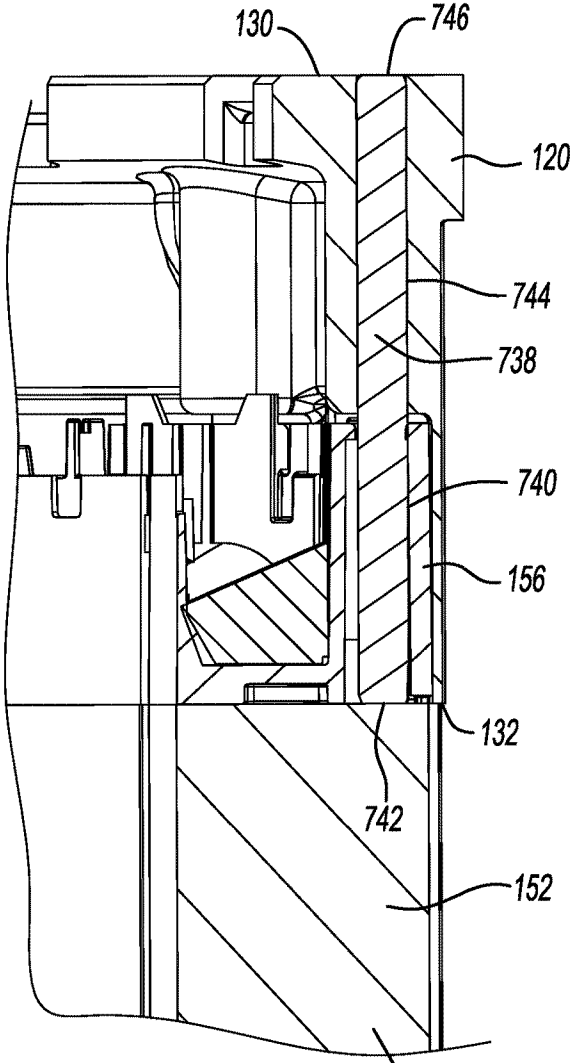
FIG. 12C is a partial cross-sectional view of the lower compressor assembly of FIG. 12B.
Figure 12B:
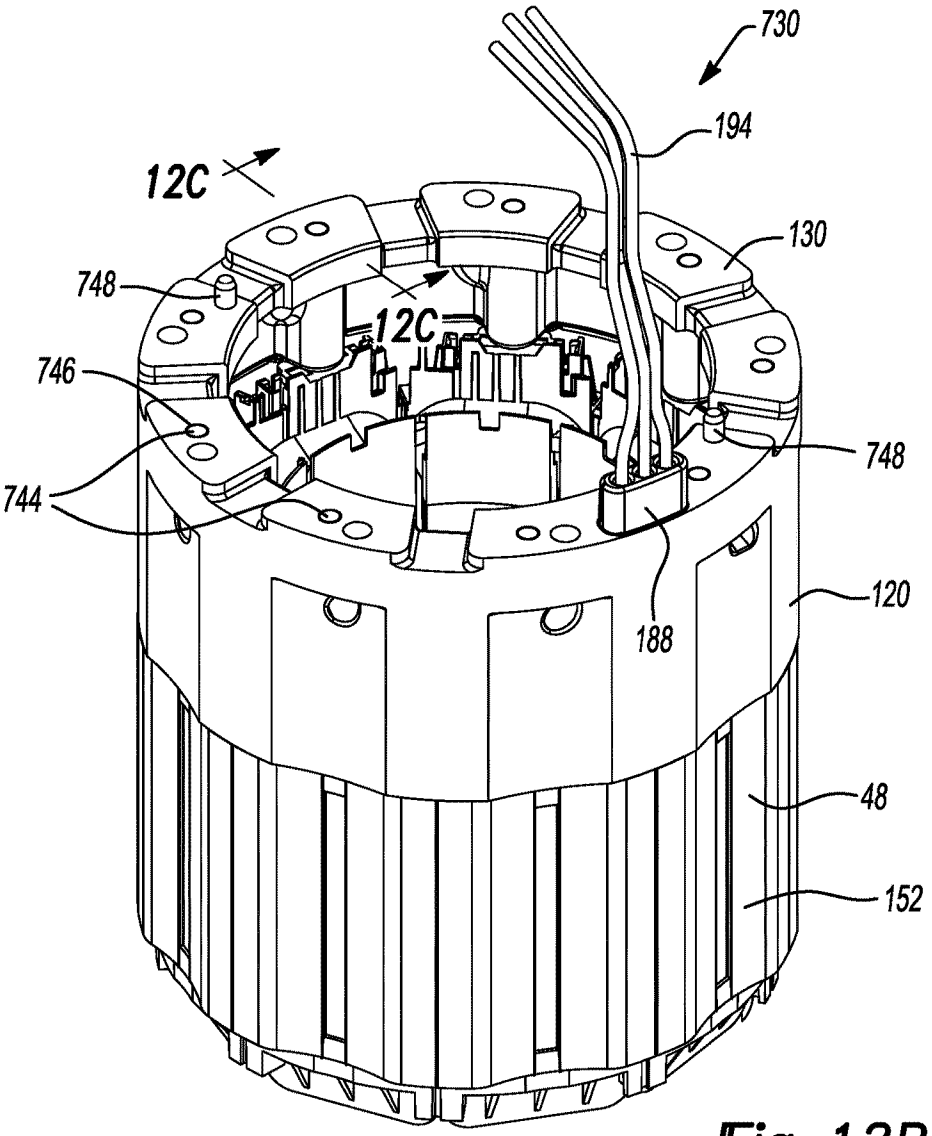
FIG. 12B is a perspective view of the lower compressor assembly of FIG. 12A.

Referring to FIGS. 12A, 12B, and 12C, a method of assembling a lower compressor assembly 730 is provided. The lower compressor assembly 730 includes the stator 48 and the shroud 120. The stator 48 includes windings 154, winding end turn supports 156, and lamination 152. Support pins 738 may be passed through openings 740 in the winding end turn supports 156 of the stator 48. A bottom surface 742 of each support pin 738 may contact the lamination 152 of the stator 48. The shroud 120 may include axial holes 744 that extend from the top surface 130 to the bottom surface 132. The axial holes 744 of the shroud 120 may then be aligned with the support pins 738 and the shroud 120 may be placed on top of the stator 48 so that the bottom surface 132 of the shroud 120 contacts the stator 48. A top end 746 of each pin 738 may be flush with the top surface 130 of the shroud 120. In an alternate assembly method, the shroud 120 may be produced from a polymer material with support pins 738 molded in place (not shown). The support pins 738 enable the shroud 120 to provide rigid support between the main bearing housing 40 and the stator 48. In a segmented stator 48, a support pin 738 may be used on each segment 148 to create a rigid support for each stator segment 148. The stator lead wires 194 of the stator 48 may be passed through the center passage 128 of the shroud 120 and up through the stator lead guide 188. At least two alignment pins 748 may extend axially from the top surface 130 of the shroud 120.

Figure 13A:
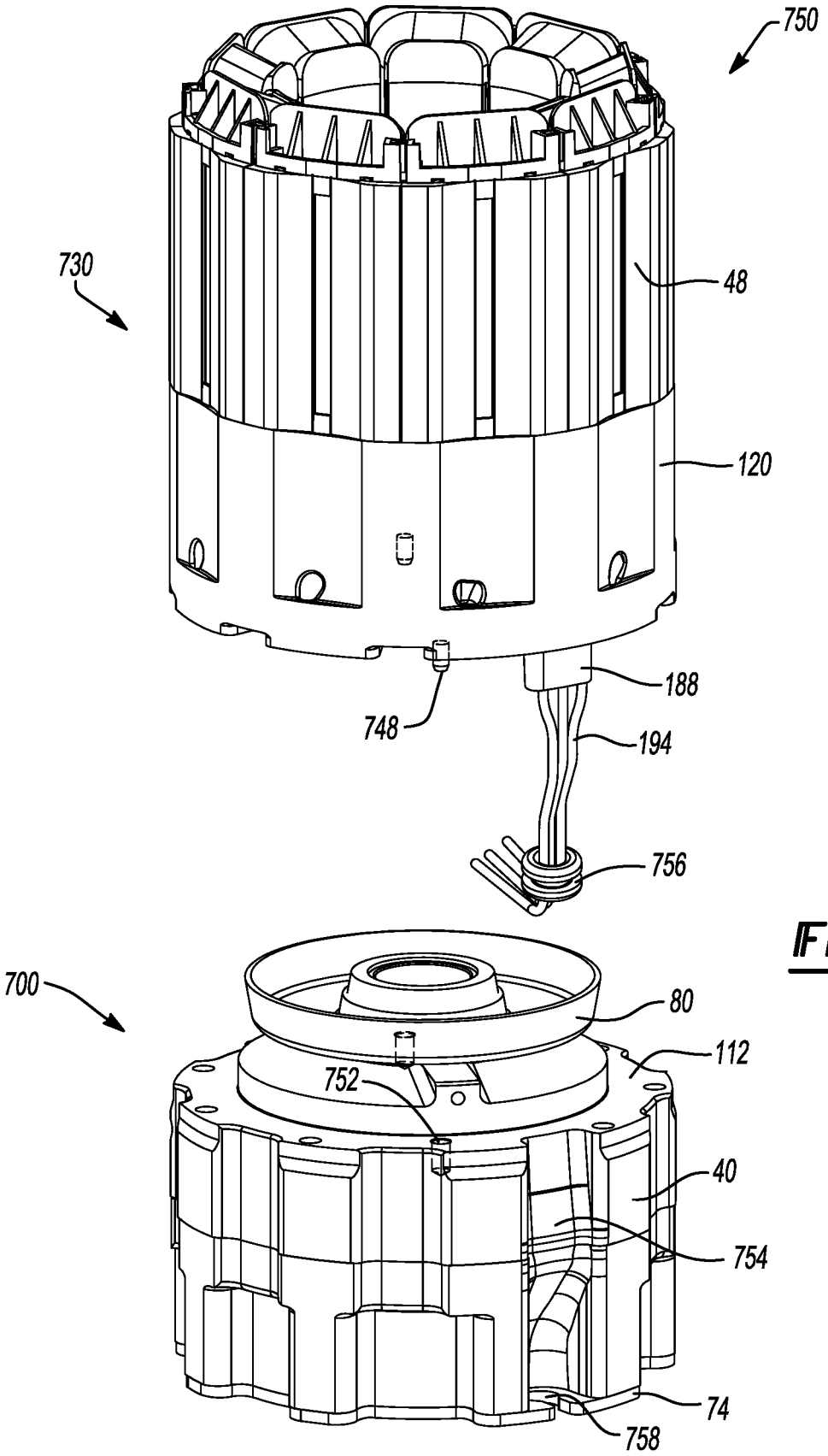
FIG. 13A is an exploded view of an internal compressor assembly of the compressor of FIG. 1.
Figure 13B:
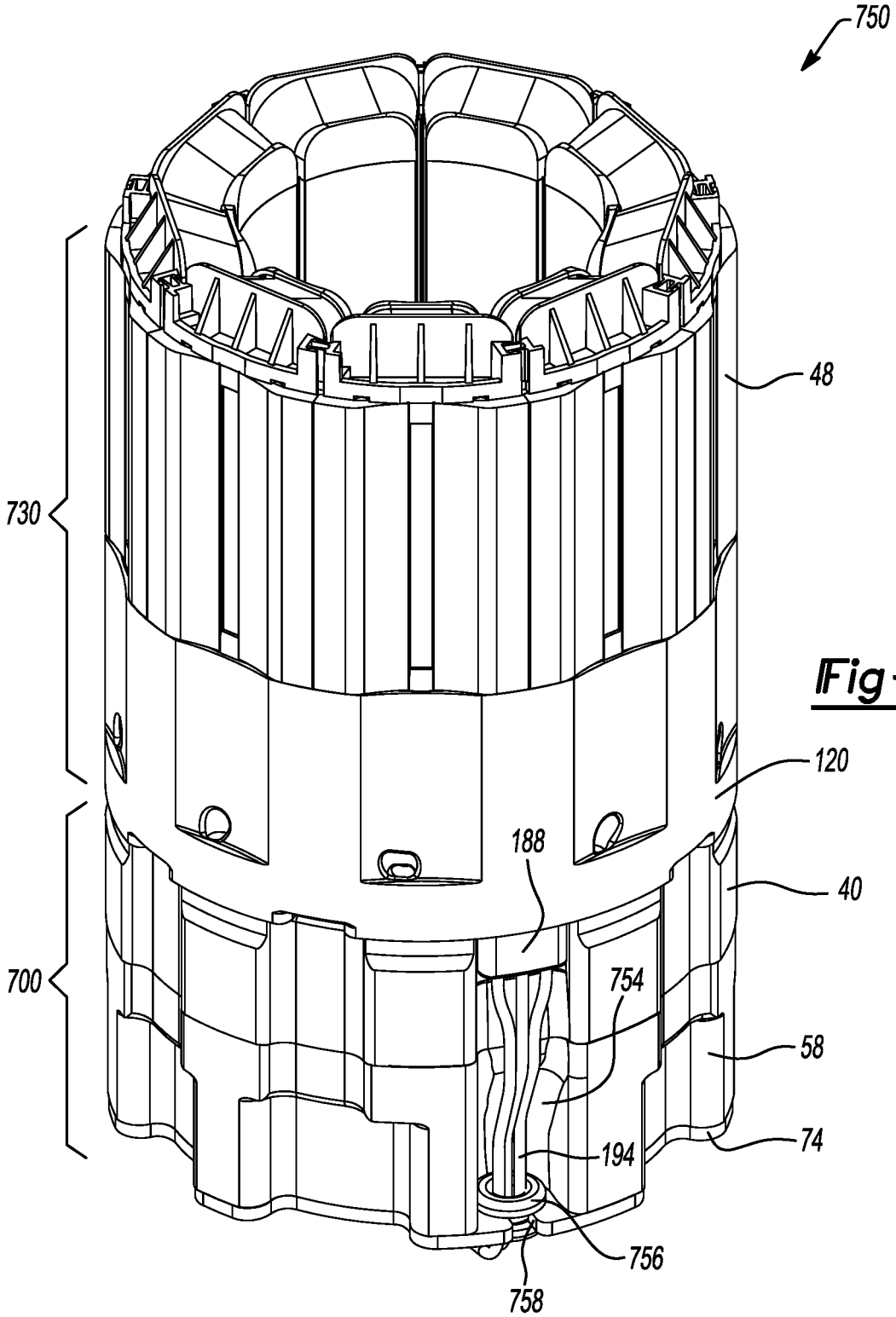
FIG. 13B is a perspective view of the assembly of FIG. 13A.

Referring to FIGS. 13A and 13B, a method of assembling an internal compressor assembly 750 is provided. The internal compressor assembly includes the upper compressor assembly 700 of FIGS. 11A and 11B, and the lower compressor assembly 730 of FIGS. 12A, 12B, and 12C. The upper compressor assembly 700 may be inverted so that the scroll cover 74 is facing downward. The upper counterweight cover 80 may be placed on the bottom surface 112 of the main bearing housing 40. The lower compressor assembly 730 may be inverted. The at least two alignment pins 748 of the shroud may be aligned with at least two alignment holes 752 that extend into the bottom surface 112 of the main bearing housing 40. The lower compressor assembly 730 may be placed on the upper compressor assembly 700 so that the alignment pins 748 of the shroud 120 are engaged with the alignment holes 752 of the main bearing housing 40. The shroud 120 may provide angular alignment of the stator 48 and the main bearing housing 40. The stator lead wires 194 may be passed through a recessed passage 754 in the upper compressor assembly 700. The stator lead wires 194 may be secured with a grommet 756 located in a notch 758 in the scroll cover 74. The grommet 756 may protect the stator lead wires 194 during cylindrical shell assembly (discussed below with references to FIGS. 14A and 14B) and end cap 28 (shown in FIG. 1) welding.

Figure 14A:
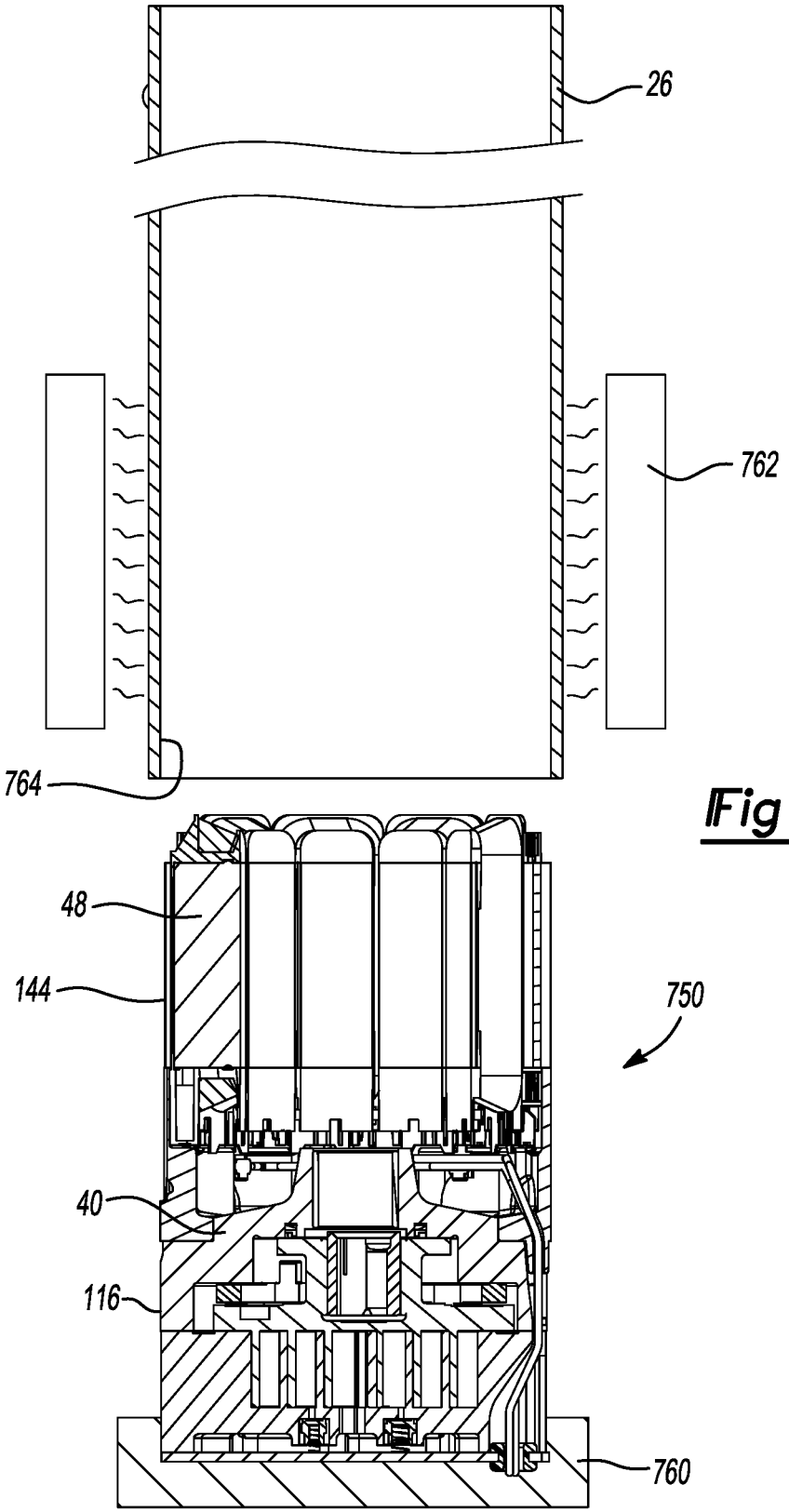
FIG. 14A is an exploded view of a compressor shell and internal compressor assembly according to the principles of the present disclosure.
Figure 14B:
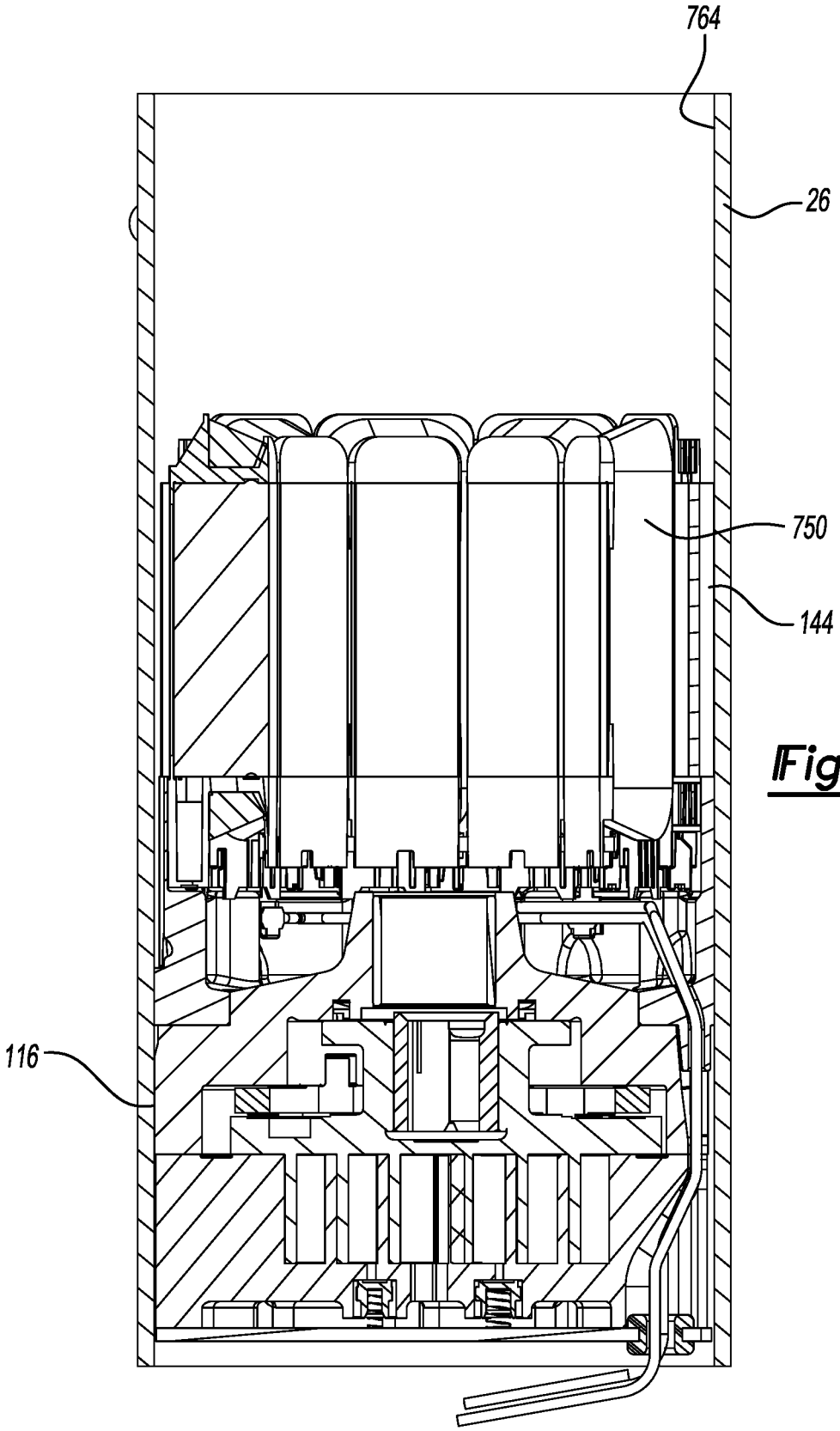
FIG. 14B is a cross-sectional view of the assembly of FIG. 14A.

Referring now to FIGS. 14A and 14B, a method of assembling a partial compressor assembly including the cylindrical shell 26 and internal compressor assembly 750 is provided. The internal compressor assembly 750 may be inverted and placed on a base fixture 760. Heat 762 may be applied to the cylindrical shell 26 so that it expands for ease of assembly. The cylindrical shell 26 may be placed around the internal compressor assembly 750. The cylindrical shell 26 may be cooled to provide a shrink or interference fit between the inner surface 764 of the cylindrical shell 26 and the outer surfaces of the internal compressor assembly, which may include the outer surface 144 of the stator 48 and the outer surface 116 of the main bearing housing 40. This method may eliminate the need for staking or pin welding the main bearing housing 40. The remaining components of the compressor 10 may be assembled according to conventional methods.

Figure 15A:
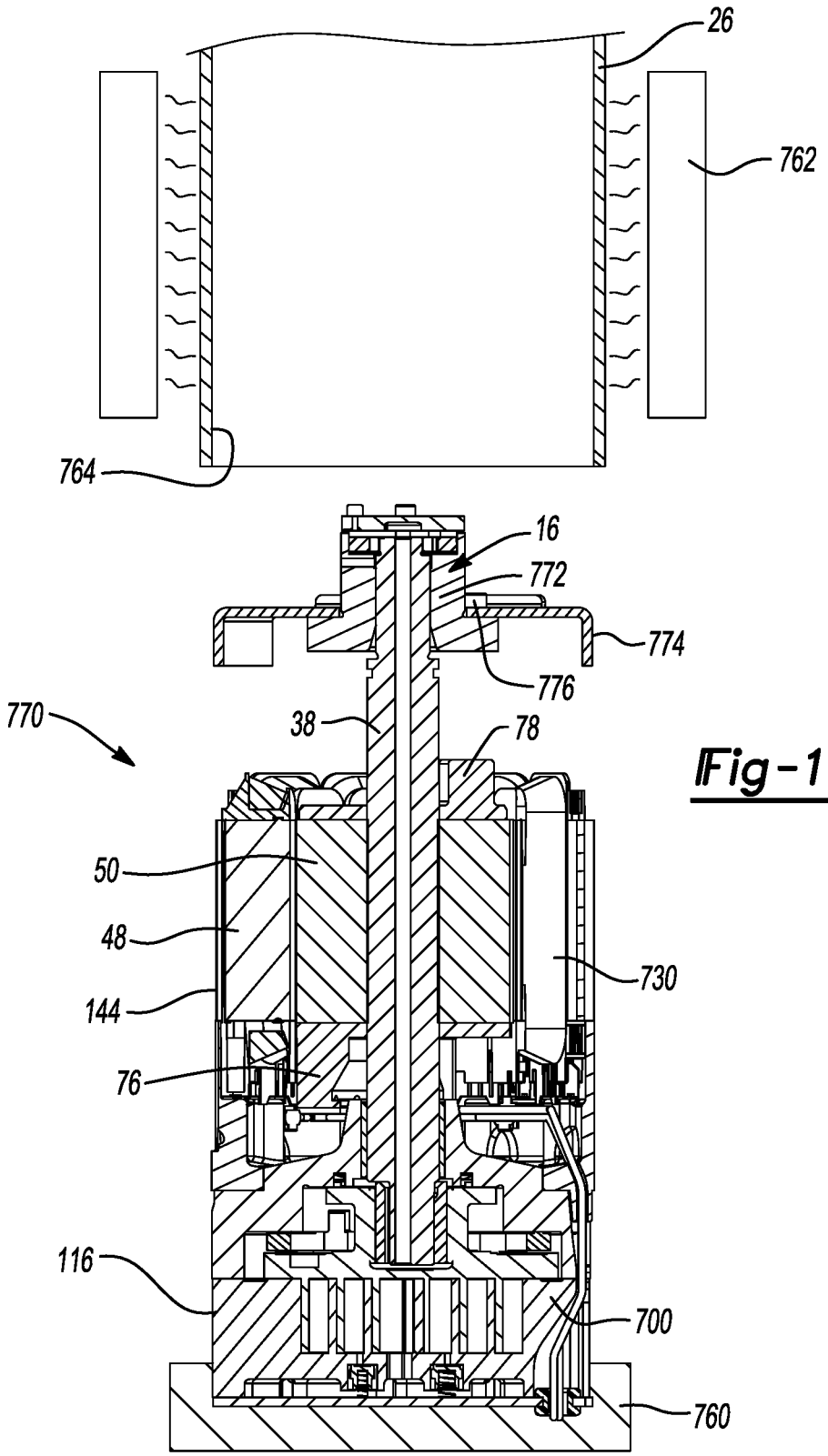
FIG. 15A is an exploded cross sectional view of a compressor shell and an internal compressor assembly including a shaft and rotor assembly and a lower bearing assembly.
Figure 15B:
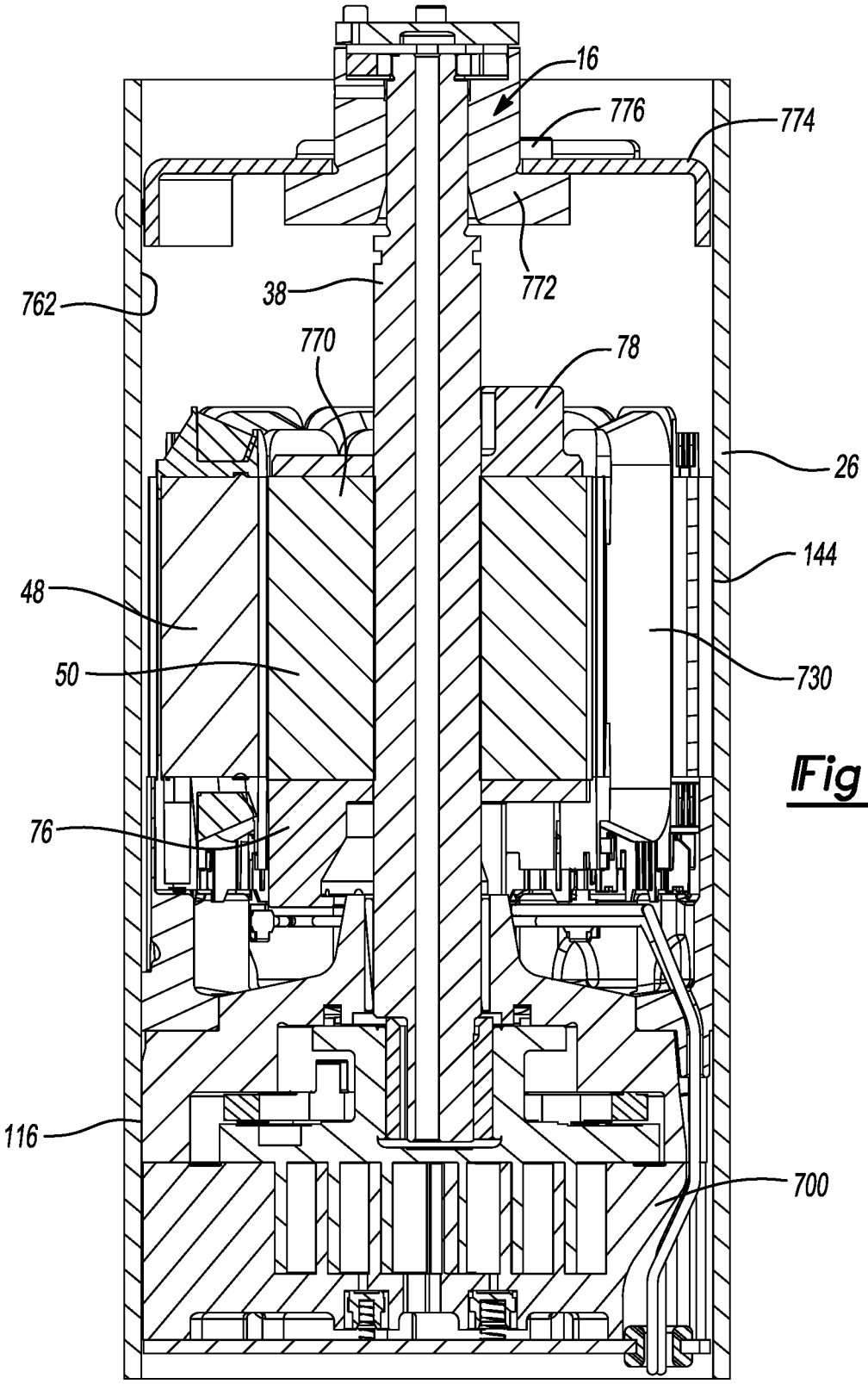
FIG. 15B is cross-sectional view of the components of FIG. 15A in assembled state.

Referring to FIGS. 15A and 15B, another method of assembling the compressor 10 is provided. An internal compressor assembly 770 may include the upper compressor assembly 700 (FIGS. 11A and 11B) and the lower compressor assembly 730 (FIGS. 12A and 12B). The internal compressor assembly 770 may also include the drive shaft 38, the rotor 50, the upper counterweight 76, and the lower counterweight 78, which can be assembled using conventional methods. The internal compressor assembly 770 may further include the lower bearing assembly 16. The lower bearing assembly 16 may include a lower bearing 772 and a lower bearing housing 774. The lower bearing 772 may be attached to the lower bearing housing 774 with a plurality of adjustment screws 776. The lower bearing housing 772 may be attached to the stator 48. The cylindrical shell 26 may be heated and assembled to the internal compressor assembly 770 per the method discussed in conjunction with FIGS. 14A and 14B above. The adjustment screws 776 of the lower bearing assembly 16 may be used for final positioning of the lower bearing 772 to achieve optimal bearing alignment after the cylindrical shell 26 is assembled to the internal compressor assembly 770. The remaining components of the compressor 10 may be assembled according to conventional methods.

Figure 16A:
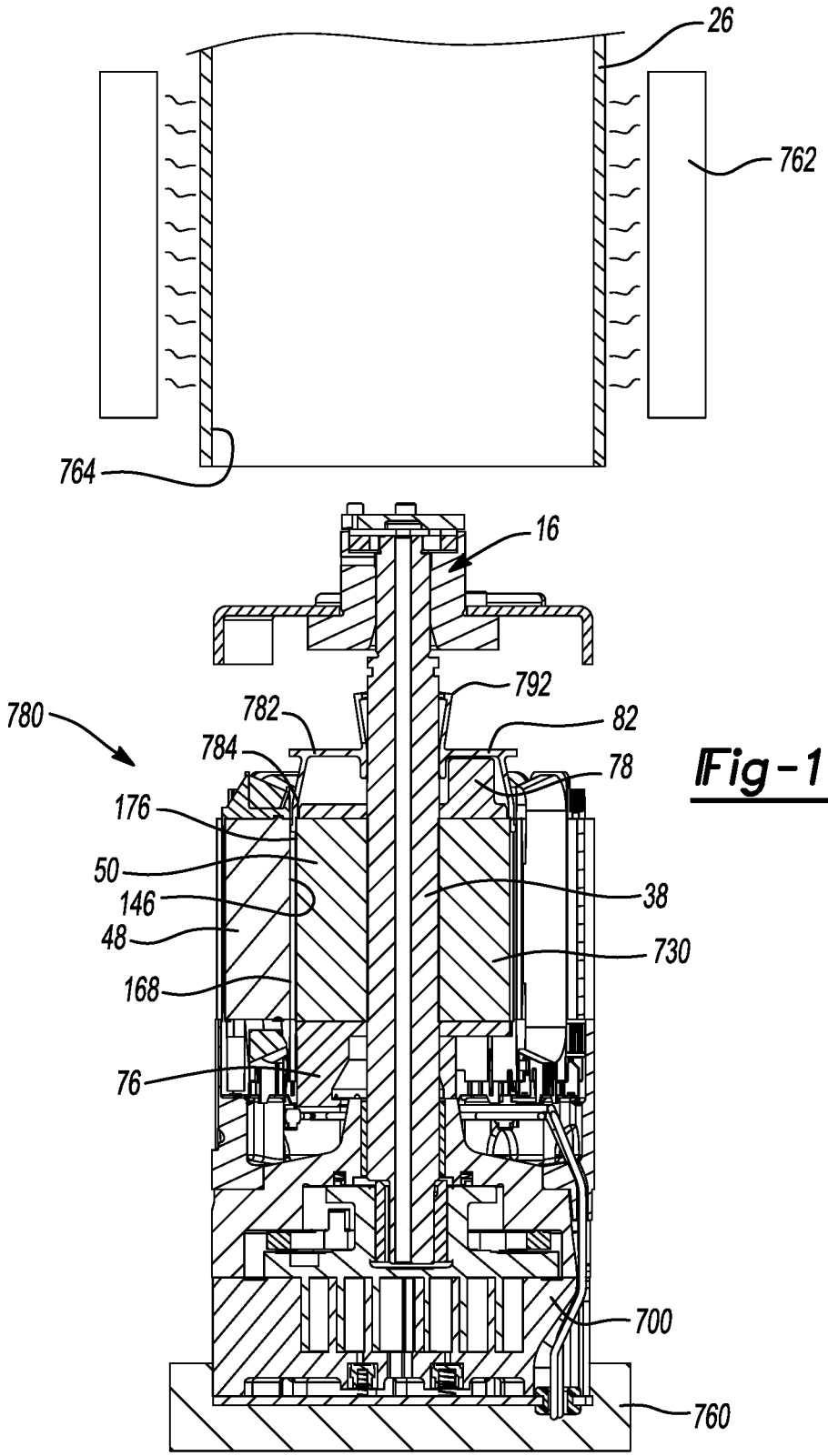
FIG. 16A is an exploded cross-sectional view of a compressor shell and an internal compressor assembly including a lower counterweight cover in pre-assembly state.
Figure 16B:
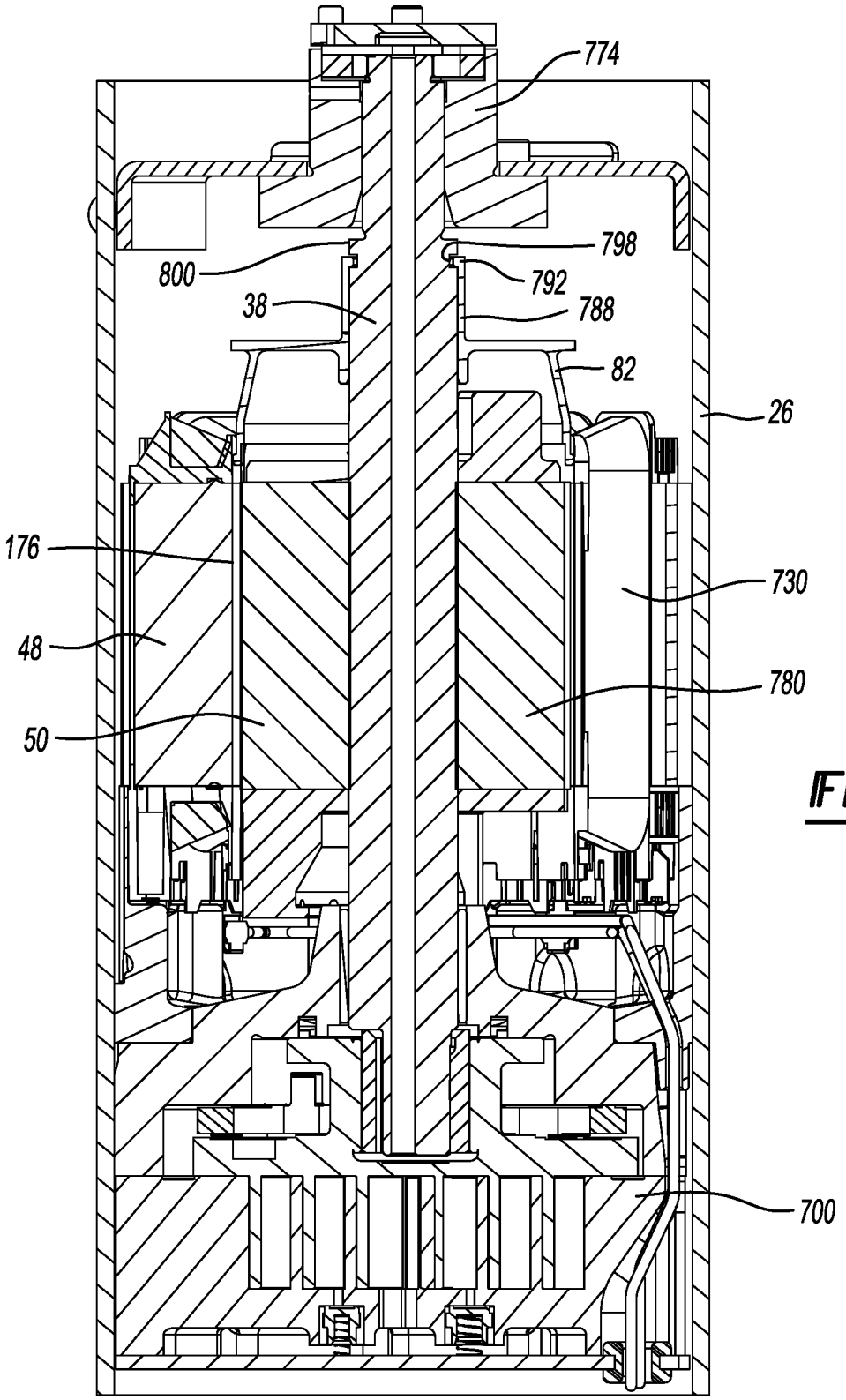
FIG. 16B is a cross-sectional view of the components of FIG. 16A in assembled state.
Figure 16C:
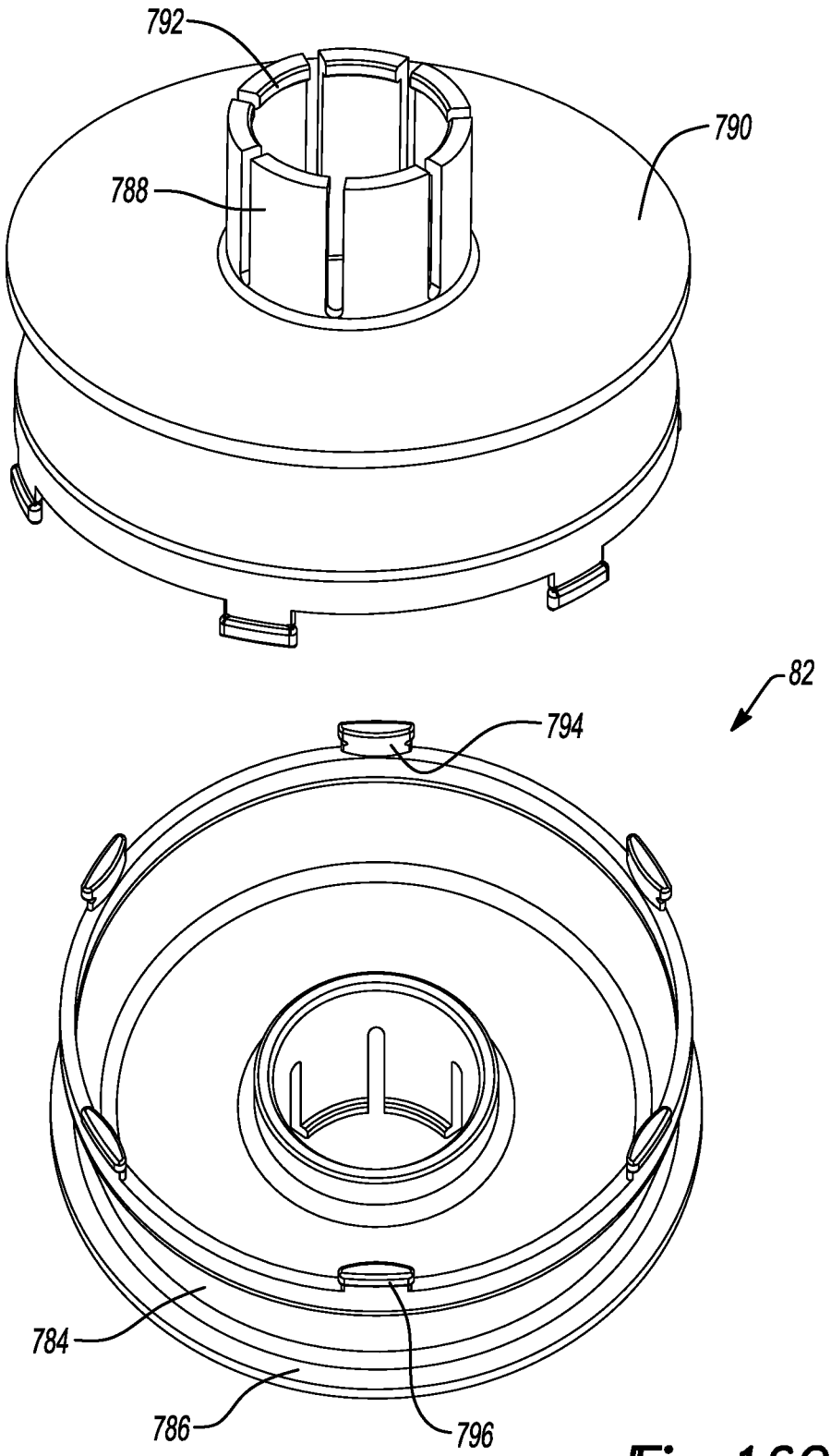
FIG. 16C is a perspective view of an lower counterweight cover of the internal compressor assembly of FIG. 16A.

Referring to FIGS. 16A and 16B, another method for assembling compressor 10 is provided. This method may be used with a pre-magnetized rotor. An internal compressor 780 assembly may include the upper compressor assembly 700, the lower compressor assembly 730, the drive shaft 38, the rotor 50, the upper counterweight 76, the lower counterweight 78, and the lower bearing assembly 16, which may be assembled according to the methods discussed in conjunction with FIGS. 14A, 14B, 15A, and 15B above. The lower counterweight cover 82 may be generally annular and may include a generally planar portion 782. As shown in FIG. 16C, the lower counterweight cover 82 may include an upper extrusion 784 extending from a top surface 786 of the generally planar portion 782 and a lower extrusion 788 extending from a bottom surface 790 of the generally planar portion 782. The lower extrusion 788 may include a circular lip 792 extending radially inward from the lower extrusion 788.

The internal compressor assembly 780 is in shown in FIG. 16A in a pre-assembly state. The lower counterweight cover 82 may be placed around the drive shaft 38 and slid toward the lower compressor assembly 730. The upper extrusion 784 of the lower counterweight cover 82 may be pressed into the second discharge gap 176 between the stator 48 and the rotor 50 so that at least a portion of an inner surface 794 of the lower counterweight cover 82 is in contact with the outer surface 168 of the rotor 50 and at least a portion of an outer surface 796 of the lower counterweight cover 82 is in contact with the inner surface 146 of the stator 48. The upper extrusion 784 of the lower counterweight cover 82 may be tapered for easier insertion in the second discharge gap 176. The upper extrusion 784 of the lower counterweight cover 82 may serve as a shim between the outer surface 168 of the rotor 50 and the inner surface 146 of the stator 48 during assembly with the cylindrical shell 26. The cylindrical shell 26 may be heated and assembled to the internal compressor assembly 780 according to the method discussed in conjunction with FIGS. 14A and 14B above.

Referring to FIG. 16B, after the cylindrical shell 26 is assembled to the internal compressor assembly 780, the lower counterweight cover 82 may be moved to its operating position. The lower bearing housing 774 may include holes or passages (not shown) to provide access to the lower counterweight cover 82 after assembly with the cylindrical shell 26. The lower counterweight cover 82 may be pulled axially away from the lower compressor assembly 730 until it is removed from the second discharge gap 176 and the circular lip 792 of the lower extrusion 788 of the lower counterweight cover 82 snaps into a circular groove 798 defined by an outer surface 800 of the drive shaft 38.

In an alternate assembly method, the lower bearing assembly 16 may be held in place by an assembly fixture during assembly of the heated cylindrical shell and the internal compressor assembly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a compression mechanism including a scroll member rotatably fixed relative to the shell;

a bearing housing rotatably supporting a drive shaft;

a shroud rotatably fixed relative to the shell and attached to the bearing housing, the shroud having an annular body including an inner surface defining a center shroud passage;

a stator fixed relative to the shell having an outer surface defining a stator passage;

a rotor attached to the drive shaft, wherein an outer surface of the rotor and an inner surface of the stator are spaced apart and define a discharge gap in fluid communication with the center shroud passage and the stator passage; and a first continuous passage extending between a top surface of the scroll member and a bottom surface of the shroud in fluid communication with the stator passage, wherein the first continuous passage includes:

a first scroll passage extending between the top surface of the scroll member and a bottom surface of the scroll member;

a first bearing housing passage extending between a top surface of the bearing housing and a bottom surface of the bearing housing in fluid communication with the first scroll passage; and a first shroud passage extending between a top surface of the shroud and the bottom surface of the shroud in fluid communication with the first bearing housing passage, wherein the first shroud passage includes a hole and an axially extending gap, wherein the hole extends through a radially outer surface of the shroud, and wherein the axially extending gap is defined by the radially outer surface of the shroud.

2. The compressor of claim 1, wherein the compression mechanism compresses working fluid from a suction pressure to a discharge pressure, and wherein the shell defines a chamber in fluid communication with the center shroud passage and containing working fluid at said discharge pressure.

3. The compressor of claim 1, further comprising a second continuous passage in fluid communication with the center shroud passage and extending between the shroud and the top surface of the scroll member.

4. The compressor of claim 3, wherein the second continuous passage includes:

a second shroud passage in fluid communication with the center shroud passage;

a second bearing housing passage in fluid communication with the second shroud passage and extending between a top surface of the bearing housing and a bottom surface of the bearing housing; and a second scroll passage in fluid communication with the second bearing housing passage and extending between the top surface of the scroll member and a bottom surface of the scroll member.

5. The compressor of claim 3, further comprising a top cap oil separator fixed with respect to the shell and having an oil collection surface and a center passage, the center passage in fluid communication with the second continuous passage and a discharge tube.

6. The compressor of claim 5, wherein at least a portion of the oil collection surface is lined with a mesh material.

7. The compressor of claim 1, wherein the outer surface of the rotor defines a plurality of axial scallops extending inward from the outer surface of the rotor.

8. The compressor of claim 1, wherein a plurality of axial fins extend outward from the outer surface of the rotor.

9. The compressor of claim 1, where the inner surface of the stator defines a plurality of axial grooves.

10. The compressor of claim 1, wherein the stator is a segmented stator including a first stator segment and a second stator segment, and wherein the stator passage is defined by a space between the first stator segment and the second stator segment.

11. The compressor of claim 1, wherein the shroud further comprises an oil drain passage extending from the inner surface of the shroud to an outer surface of the shroud.

12. The compressor of claim 1, wherein at least a portion of the stator is lined with a mesh material.

13. The compressor of claim 1, further comprising an upper counterweight fixed relative to the rotor, the upper counterweight having an annular body with a partial cylindrical extrusion extending from a top surface of the annular body, the partial cylindrical extrusion comprising:

a counterweight passage extending from an inner surface of the partial cylindrical extrusion to an outer surface of the partial cylindrical extrusion; and a lip located above the counterweight passage, wherein an inner diameter of the partial cylindrical extrusion at the lip is smaller than the inner diameter of the partial cylindrical extrusion at a location of the counterweight passage, wherein rotation of the rotor causes oil that drips from a bearing of the bearing housing to move upward along the inner surface of the partial cylindrical extrusion, be deflected by the lip, and travel through the counterweight passage.

14. The compressor of claim 13, the partial cylindrical extrusion further comprising a lower portion; an upper portion; and an angled portion disposed between the lower portion and the upper portion, wherein the upper portion has an inner diameter greater than the inner diameter of the lower portion, and the lip has an inner diameter smaller than the inner diameter of the upper portion.

15. The compressor of claim 14, wherein the counterweight passage is disposed on the upper portion of the partial cylindrical extrusion.

16. The compressor of claim 1, further comprising a second continuous passage extending between a top surface of end turn supports of the stator and the top surface of the scroll member, the second continuous passage in fluid communication with a center end turn support passage defined by the end turn supports.

17. The compressor of claim 1, wherein the shroud further comprises a stator lead guide including a passage through which stator leads extend.

18. The compressor of claim 1, further comprising a second continuous passage extending between the top surface of the scroll member and a bottom surface of the bearing housing, the second continuous passage in fluid communication with a shroud gap between an outer surface of the shroud and an inner surface of the shell.

19. A compressor comprising:

a shell;

a compression mechanism including a scroll member rotatably fixed relative to the shell;

a bearing housing rotatably supporting a drive shaft;

a shroud rotatably fixed relative to the shell and attached to the bearing housing, the shroud having an annular body including an inner surface defining a center shroud passage;

a stator fixed relative to the shell having an outer surface defining a stator passage;

a rotor attached to the drive shaft, wherein an outer surface of the rotor and an inner surface of the stator are spaced apart and define a discharge gap in fluid communication with the center shroud passage and the stator passage; and a first continuous passage extending between a top surface of the scroll member and a bottom surface of the shroud in fluid communication with the stator passage, wherein the shroud further comprises a stator lead guide including a passage through which stator leads extend.

20. The compressor of claim 19, further comprising a second continuous passage extending between the top surface of the scroll member and a bottom surface of the bearing housing, the second continuous passage in fluid communication with a shroud gap between an outer surface of the shroud and an inner surface of the shell.

21. A compressor comprising:

a shell;

a compression mechanism including a scroll member rotatably fixed relative to the shell;

a bearing housing rotatably supporting a drive shaft;

a shroud rotatably fixed relative to the shell and attached to the bearing housing, the shroud having an annular body including an inner surface defining a center shroud passage;

a stator fixed relative to the shell having an outer surface defining a stator passage;

a rotor attached to the drive shaft, wherein an outer surface of the rotor and an inner surface of the stator are spaced apart and define a discharge gap in fluid communication with the center shroud passage and the stator passage;

a first continuous passage extending between a top surface of the scroll member and a bottom surface of the shroud in fluid communication with the stator passage; and a second continuous passage extending between the top surface of the scroll member and a bottom surface of the bearing housing, the second continuous passage in fluid communication with a shroud gap between an outer surface of the shroud and an inner surface of the shell.

* * * * *